US006082837A

United States Patent [19]

Battochio et al.

[11] Patent Number: 6,082,837

[45] Date of Patent: Jul. 4, 2000

[54] MODULAR DISPLAY SYSTEM OF INTERLOCKING COMPONENTS

[75] Inventors: Gilberto Battochio, Bassano del Grappa, Italy; James C. Maharg, Ridgefield, Conn.

[73] Assignee: Alu, Inc., New York, N.Y.

[21] Appl. No.: 08/979,855

[22] Filed: Nov. 26, 1997

Related U.S. Application Data

[60] Provisional application No. 60/031,869, Nov. 27, 1996, abandoned.

[51] Int. Cl.[7] ..... A47F 3/00

[52] U.S. Cl. ..... 312/140; 312/265.4; 403/170; 411/219

[58] Field of Search ..... 312/108, 111, 312/140, 265.1, 265.4, 265.3; 403/231, 170, 169, 217, 219, 176, 172; 411/185, 187, 354, 399

[56] References Cited

U.S. PATENT DOCUMENTS

| | | | |
|---|---|---|---|
| 754,233 | 3/1904 | Partheymueller | 312/140 |
| 3,399,856 | 9/1968 | Pecaut . | |
| 3,425,721 | 2/1969 | Agee . | |
| 3,613,897 | 10/1971 | Filler . | |
| 3,835,354 | 9/1974 | Torres-Pena . | |
| 3,912,410 | 10/1975 | Pofferi . | |
| 4,021,128 | 5/1977 | Chiames . | |
| 4,432,590 | 2/1984 | Lawrence | 312/265.4 |
| 4,501,512 | 2/1985 | Hiltz . | |
| 5,090,835 | 2/1992 | Cox . | |
| 5,149,236 | 9/1992 | Rapayelian . | |
| 5,255,803 | 10/1993 | Pavone et al. . | |
| 5,477,594 | 12/1995 | LePage . | |
| 5,695,263 | 12/1997 | Simon et al. | 312/265.4 |

FOREIGN PATENT DOCUMENTS

| | | | |
|---|---|---|---|
| 56598 | 6/1967 | Germany | 312/140 |

*Primary Examiner*—Peter M. Cuomo
*Assistant Examiner*—Gerald A. Anderson
*Attorney, Agent, or Firm*—Barry G. Magidoff

[57] ABSTRACT

A modular display system of interlocking components, and more particularly, a modular cubic display frame, comprising two sets of four mitered frame members, the two sets defining opposing rectangular end planes, and a set of longitudinal frame members extending perpendicularly between the corners of the two end planes. The end and the longitudinal frame members are interconnected at each corner utilizing a threaded bolt or screw having a lipped head. The lip projecting from the head engages a corresponding groove formed in the outer surfaces of the mitered corners of the end frame members, while the externally-threaded shaft of the screw engages an internally-threaded bore in the end of the longitudinal frame member. All of the frame members have longitudinal channels formed along each side and one corner, for attaching two modular display frames to each other, or for attaching a variety of auxiliary devices to a display frame. The channels are identical in size and configuration, having a T-shaped cross-section. The display frames are joined to each other by connecting strips configured to be matingly received in the channels; that is, the strips have I-shaped cross-sections.

20 Claims, 29 Drawing Sheets

MODULAR DISPLAY SYSTEM OF INTERLOCKING COMPONENTS

CROSS-REFERENCE TO RELATED APPLICATION

This application claims priority to U.S. provisional application No. 60/031,869, filed Nov. 27, 1996, abandoned.

BACKGROUND OF THE INVENTION

1. Field of the Invention

The present invention relates to modular display systems. More specifically, the invention relates to modular display systems, the basic modules of which are interlocking cubes adapted to received ancillary devices.

2. Related Art

Corner connection systems are disclosed in U.S. Pat. Nos. 3,912,410; 4,501,512; 4,021,128; and 3,835,354. The concept of providing longitudinal channels along frame members, for attaching various accessories, is disclosed in U.S. Pat. Nos. 3,399,856; 3,613,897; 5,255,803, and 5,477,594. Various interconnection systems using a member of I-shaped cross-section are disclosed in U.S. Pat. Nos. 3,425,721; 5,090,835; and 5,149,236.

SUMMARY OF THE INVENTION

The present invention is directed to a modular display system of interlocking components, and more particularly, a modular cubic display frame, comprising two sets of four mitered frame members, the two sets defining opposing rectangular end planes, and a set of longitudinal frame members extending perpendicularly between the corners of the two end planes. The end and the longitudinal frame members are interconnected at each corner utilizing a threaded bolt or screw having a lipped head. The lip projecting from the head engages a corresponding groove formed in the outer surfaces of the mitered corners of the end frame members, while the externally-threaded shaft of the screw engages an internally-threaded bore in the end of the longitudinal frame member.

All of the frame members have longitudinal channels formed along each side and one corner, for attaching two modular display frames to each other, or for attaching a variety of auxiliary devices to a display frame. The channels are identical in size and configuration, having a T-shaped cross-section. The display frames are joined to each other by connecting strips configured to be matingly received in the channels; that is, the strips have I-shaped cross-sections.

Auxiliary devices such as crossbars, hang rods, legs, shelves, panels, doors, and drawers can be attached to a display frame using specially configured connectors which are selectively lockable into the channels.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
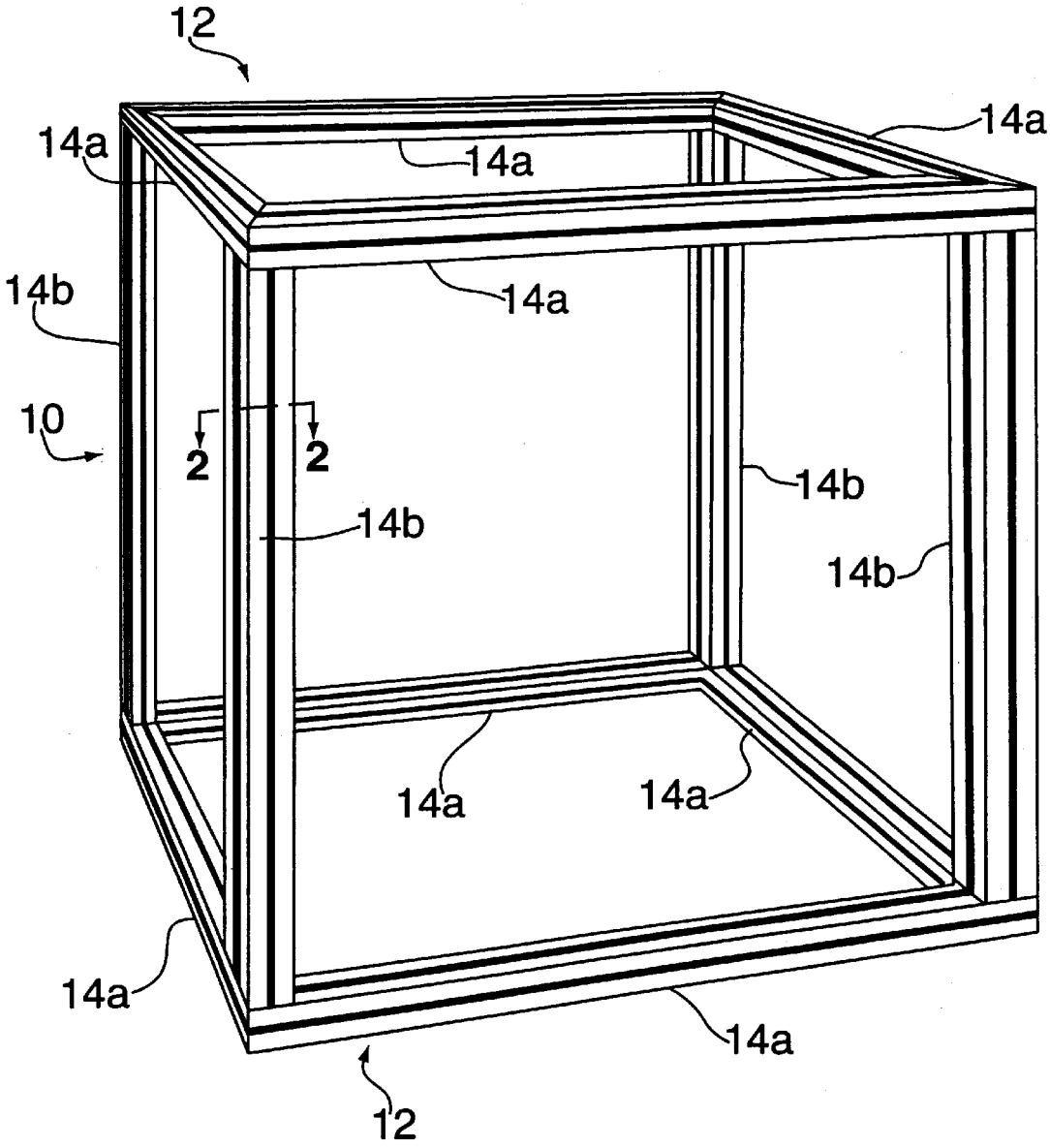
FIG. 1 is a perspective view of a cube module of the modular display system in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIG. 1, there is shown a cube module 10 of the modular display system in accordance with the present invention. The cube module 10 comprises two end frames 12 of four end frame members 14*a*, and four side frame members 14*b* joining the two end frames 12. The twelve frame members 14*a* and 14*b* thus define the edges of the cube. Although the module 10 is referred to as a cube, it will be appreciated that by elongating any four parallel frame members 12 relative to the remaining parallel members 12, the module 10 can be configured as a rectangular prism, rather than a cube, without substantially affecting the function of the invention.

As can further be seen from FIG. 1, and as will be discussed in greater detail hereafter, the ends of the end frame members 14*a* are mitered at their joints with each other, while the ends of the side frame members 14*b* are squared off at their joints with the corners of the end frames 12. Otherwise, end frame members 14*a* and side frame members 14*b* are essentially identical frame members 14 having a unique cross-section, shown in FIG. 2, which enables individual modules 10 to be joined together, as will also be discussed in greater detail hereafter.

Figure 2:
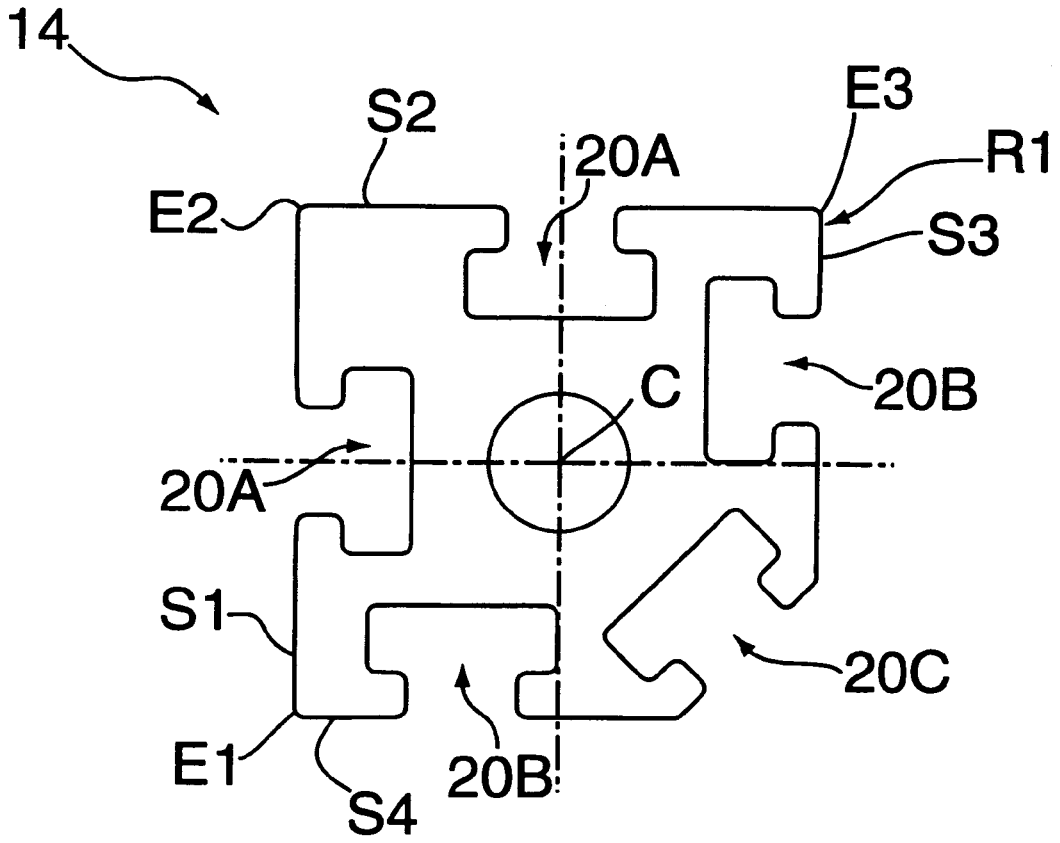
FIG. 2 is a cross-sectional view of a frame member of the cube module of FIG. 1, taken along line 2—2 of FIG. 1.

Referring now to FIG. 2, it can be seen that each frame member 14 has a cross-section which is a soft square (that is, a square with rounded edges), interrupted by five channels 20 of T-shaped cross-section and identical dimensions. The edges of all of the channels 20 are radiused.

Two channels 20*a* are formed in adjacent first and second sides S1 and S2 of the frame member 14 centered between the first and second edges E1 and E2 and between the second and third edges E2 and E3 of the adjacent first and second sides S1 and S2 of the frame member 14, two channels 20*b* are adjacent the first and third edges E1 and E3 between the first and fourth sides and between the second and third sides, respectively, and a fifth channel 20*c* is formed on the fourth edge E4 between the third and fourth sides S3 and S4, thus effectively cutting off the fourth edge E4. One side edge of each second channel 20*b* aligns with the center line of the first channel 20*a* on the opposite side of frame member 14. Each frame member 14 is symmetric about a diagonal plane through the second edge E2 and center C. When the frame members 14 are assembled to form a module 10, the third channel 20*c* is oriented toward the interior of the module 10.

Figure 3A:
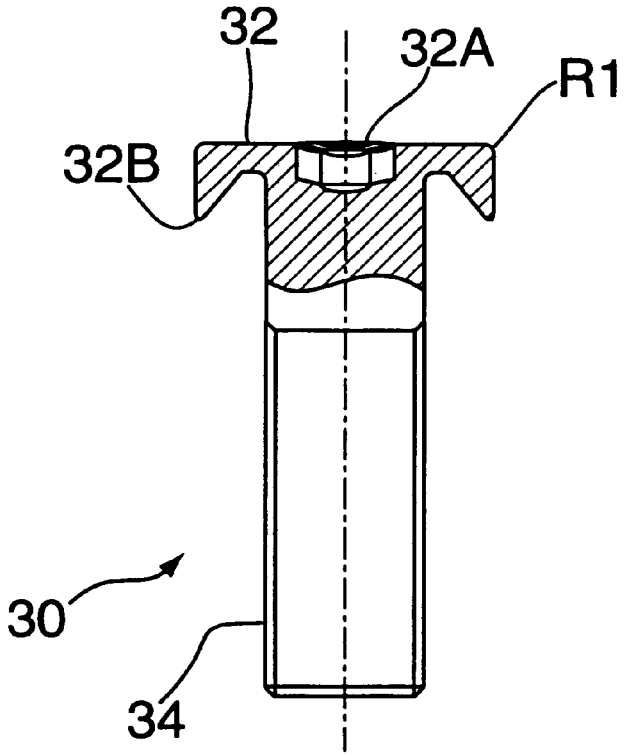
FIG. 3A is an elevational view, partially in cross-section, of a connector for connecting frame members of the type shown in FIG. 2 to form the cube module of FIG. 1.
Figure 3B:
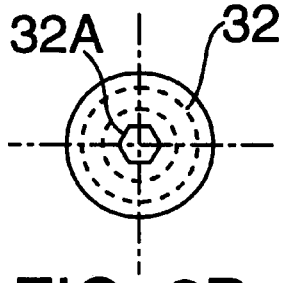
FIG. 3B is a top plan view of the connector of FIG. 3A.
Figure 5B:
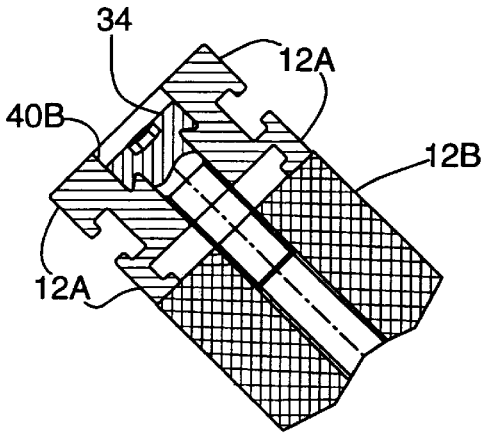
FIG. 5B is a cross-sectional view of FIG. 5A, taken along line 5B—5B.
Figure 5A:
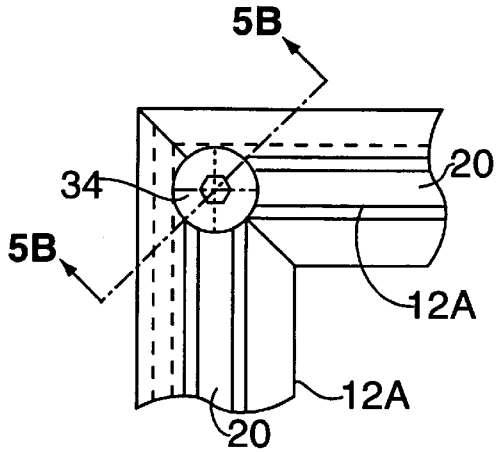
FIG. 5A is an assembled view of the three frame members and the connector shown in FIG. 4A.
Figure 4B:
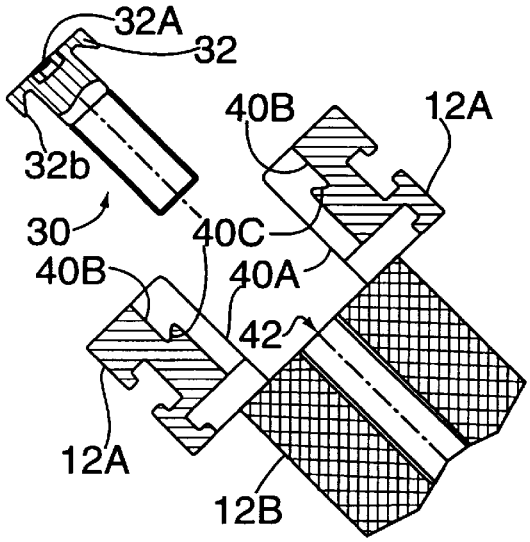
FIG. 4B is a cross-sectional view of FIG. 4A, taken along line 4B—4B.
Figure 4A:
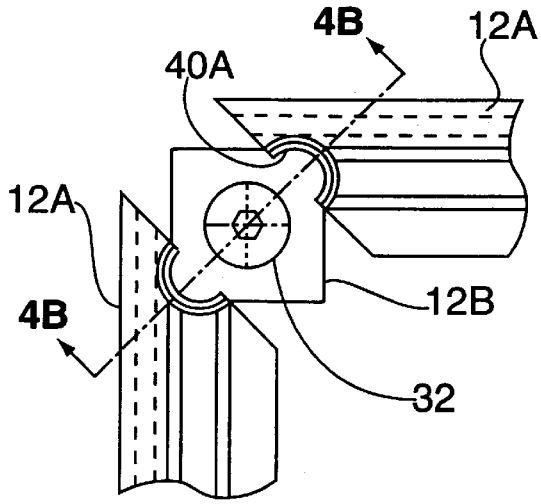
FIG. 4A is an exploded plan view of three frame members of the type shown in FIG. 2 arranged to form a corner of a cube module, and the connector of FIG. 3A.

Referring now to FIGS. 3A, 3B, 4A, 4B, 5A, and 5B, there is shown a connector 30 for connecting the end frame members 14*a* and side frame members 14*b* together to form a module 10 in accordance with the invention. As shown in FIGS. 3A and 3B, connector 30 is a screw having a head 32 and a shaft 34. Head 32 has an axial recess 32*a* in its upper surface for receiving the mating head of a wrench, and an annular tapered lip 32*b* projecting from its lower surface, while the shaft 34 is conventionally provided with external threads.

As shown in FIGS. 4A, 4B, 5A, and 5B, at each corner of the module 10, the mitered ends of end frame members 14*a* are bored to matingly receive the screw 30, the bores having an inner portion 40*a* with a smaller radius corresponding to that of the screw shaft 34 and an outer portion 40*b* with a larger radius corresponding to that of the screw head 32. The outer portion 40*b* is provided with a tapered circumferential groove 40*c* for matingly receiving the tapered lip 32*b* of the screw 30. Further, the squared off end of the side frame member 14*b* is provided with an internally-threaded axial bore 42 for matingly receiving the externally-threaded shaft 34 of the screw 30.

Preferably, frame members 14 and screws 30 are made of aluminum. However, it will be appreciated by those of skill in the art that other metals, as well as plastics, can also be used.

Figure 6A:
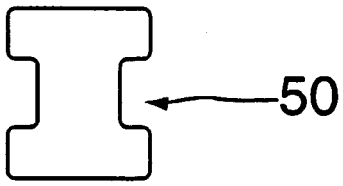
FIG. 6A is a cross-sectional view of a connecting strip for connecting two cube modules of the type shown in FIG. 1.
Figure 6B:
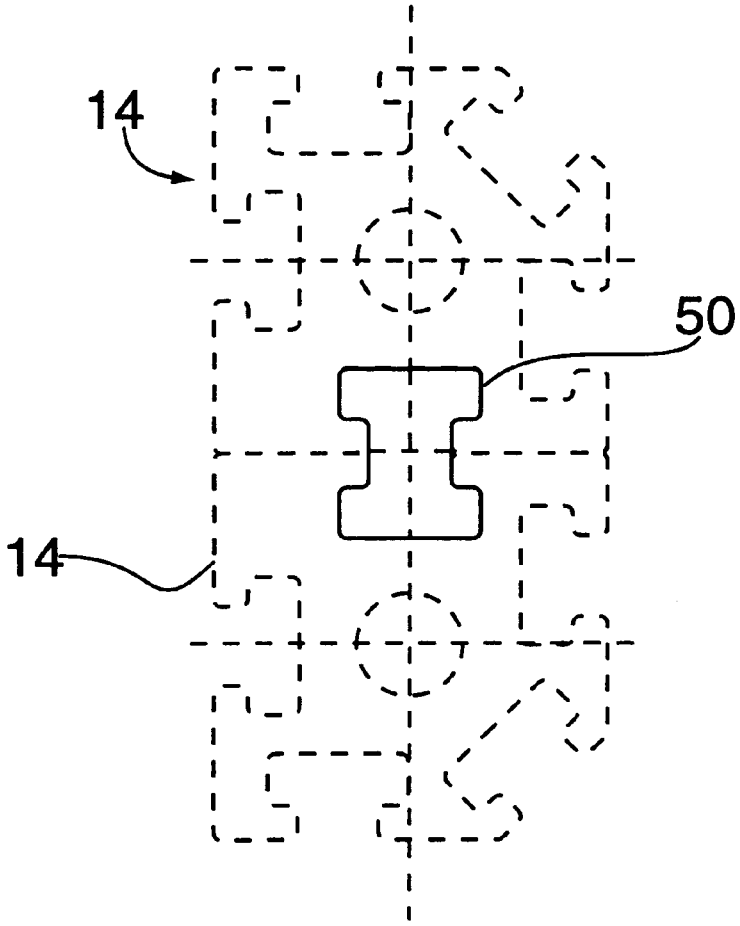
FIG. 6B is a cross-sectional view similar to FIG. 6A, interlocked with the frame members of two cube modules, the frame members being shown in dashed lines.

Referring now to FIGS. 6A and 6B, there is shown a connecting strip 50 for connecting two modules 10. Connecting strip 50 preferably is made of a plastic material such as PVC, although other materials having similar characteristics of flexibility, resilience, and durability can also be used.

The connecting strip 50 has an I-shaped cross-section with radiused edges, dimensioned to be matingly received in the channels 20 of the frame members 14, as shown in FIG. 6B. Although the frame members 14 in FIG. 6B are shown joined along two sides, it will be appreciated by those of skill in the art that as all of the channels 20 are of the same dimension, any two frame members 14 can also be joined corner to corner or side to corner, as well. Thus, the modules 10 can be jointed together in a variety of configurations simply by connecting their adjacent frame members 14 using the connecting strips 50.

In addition to providing a means for connecting adjacent modules 10 together, channels 20 can also be used for attaching a variety of ancillary or auxiliary devices to the frame members 14. Some of these devices are shown in the remaining Figures.

Figure 7A:
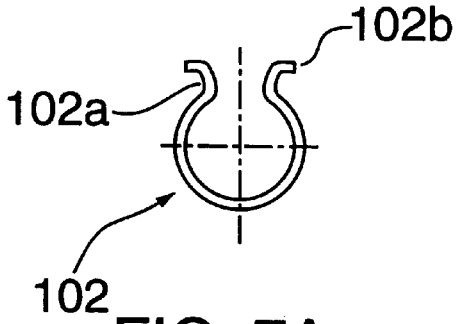
FIG. 7A is an end elevational view of a clip for attaching wiring to the module of FIG. 1, in the uncompressed state.
Figure 7B:
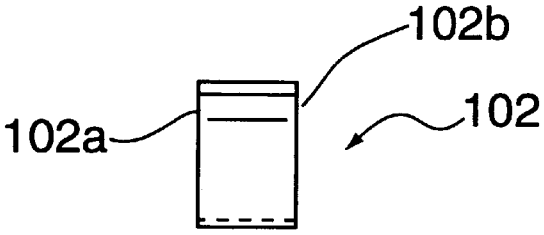
FIG. 7B is a side elevational view of the clip of FIG. 7A.
Figure 7C:
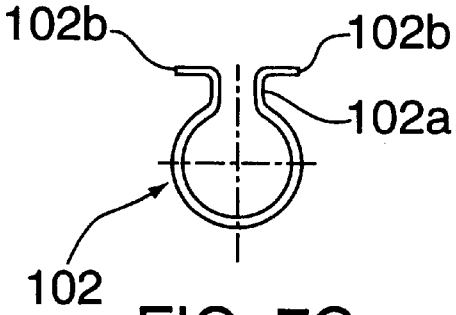
FIG. 7C is a side elevational view of the clip of FIG. 7A, in the compressed state.

FIGS. 7A and 7B show a clip 102 designed to secure wiring to the frame members 14. The clip is formed of a flexible and resilient material, such as a soft steel, so that its legs 102*a* can be pressed together, enabling the feet 102*b* extending outwardly from the legs 102*a* to be inserted into a channel 20.

Figure 8A:
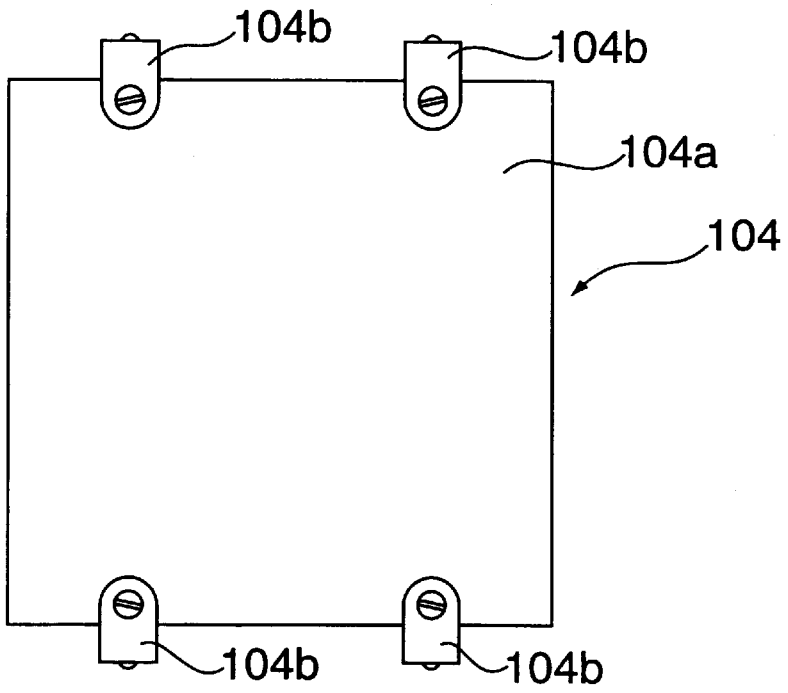
FIG. 8A is a front elevational view of a panel assembly for insertion into a side of the module of FIG. 1.
Figure 8B:
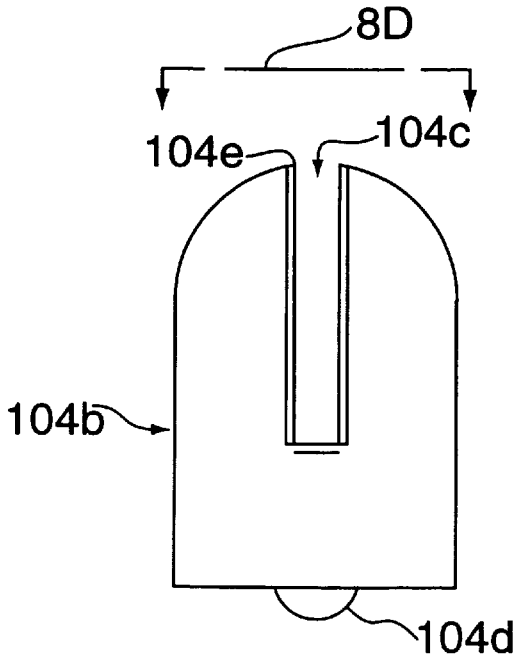
FIG. 8B is a side elevational view of a panel holder of the panel assembly of FIG. 8A.
Figure 8C:
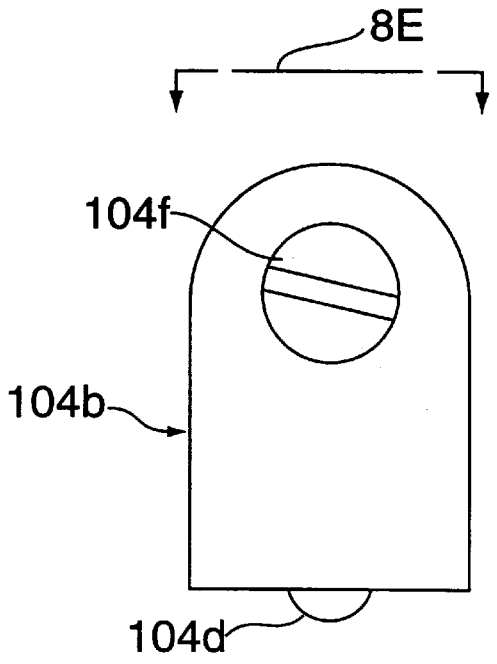
FIG. 8C is a front elevational view of the panel holder of FIG. 8B.
Figure 8D:
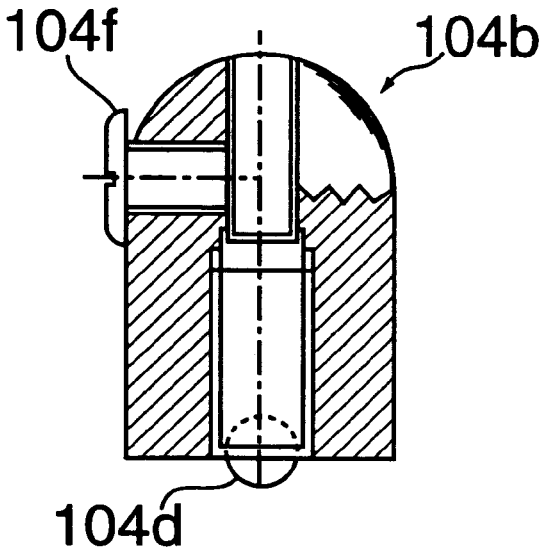
FIG. 8D is a cross-sectional view of the panel holder, taken along line 8D—8D of FIG. 8B.
Figure 8E:
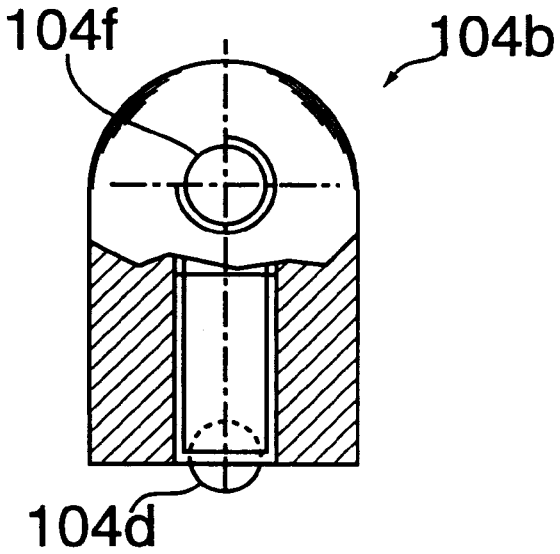
FIG. 8E is a cross-sectional view of the panel holder, taken along line 8E—8E of FIG. 8C.

FIGS. 8A, 8B, and 8C show a panel assembly 104 and the components thereof intended for insertion into the sides or ends of a module 10. As shown in FIG. 8A, the panel assembly 104 comprises a panel 104*a* and four panel holders 104*b* secured along two sides of the panel 104*a*. The panel holders 104*b* can be made of a soft steel.

Each panel holder 104*b* has a slot 104*c* at one end for receiving an edge of the panel 104*a* and a spring-loaded bearing 104*d* at the other end for insertion into a channel 20. The slot 104*c* can be provided with pads 104*e*, to prevent scratching of the panel 104*a* and a screw 104*f* for tightening against the panel 104*a* to hold it in place in the slot 104*c*. The tension of the spring-loaded bearings 104*d* is adjusted so that they can be retracted easily to permit insertion or removal of the assembly 104 with respect to a side of the module 10, with the bearings 104*d* extending into the channels 20 when the assembly is in place. The panel 104*a* can be in the form of a mirror, a transparent or semi-transparent window, or opaque.

Figure 9A:
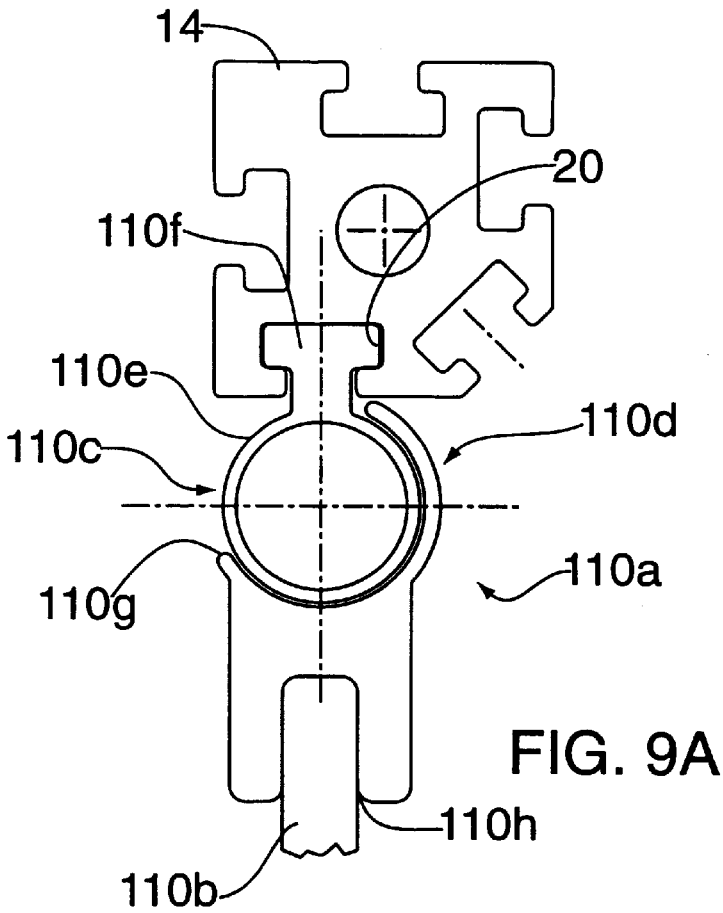
FIG. 9A is an end plan view of a door hinge attached to a frame member of the type shown in FIG. 2, with the hinge in the closed position, the door being shown in dashed lines.
Figure 9B:
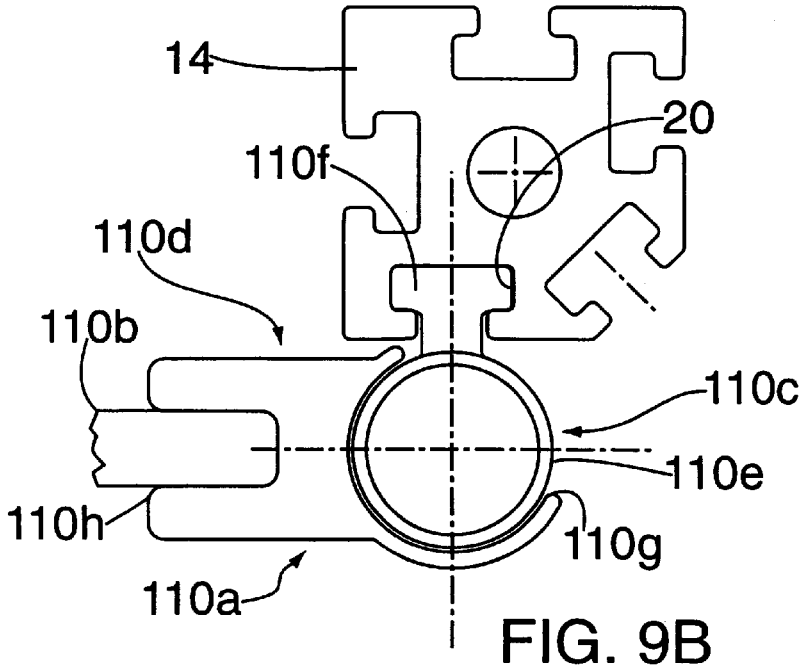
FIG. 9B is an end plan view of the door hinge and frame member of FIG. 9A, with the hinge in the open position, and the door being shown in dashed lines.

FIGS. 9A and 9B show a door hinge 110*a* for attaching a door 110*b* to one of the frame members 14 of a module 10. The door hinge 110*a* comprises a pin portion 110*c* and a barrel portion 110*d*, both preferably made of aluminum. The pin portion 110*c* in turn includes a cylindrical pin 110*e* and a connector 110*f* of T-shaped cross-section projecting outwardly from the pin 110*e* and dimensioned to be matingly received in one of the channels 20 of a frame member 14; while the barrel portion 110*e* includes at one end a channel 110*g* of generally C-shaped cross-section for pivoting engagement with the pin 110*e*, and at the other end a groove 110*h* of generally U-shaped cross-section for receiving an edge of the door 110*b*.

Referring now to FIGS. 10A–10K, there is shown a crossbar 120 for positioning between two frame members 14 of a module 10, and a locking assembly 122 for locking the crossbar 120 in place in the channels 20 of the two frame members 14.

Figure 10A:
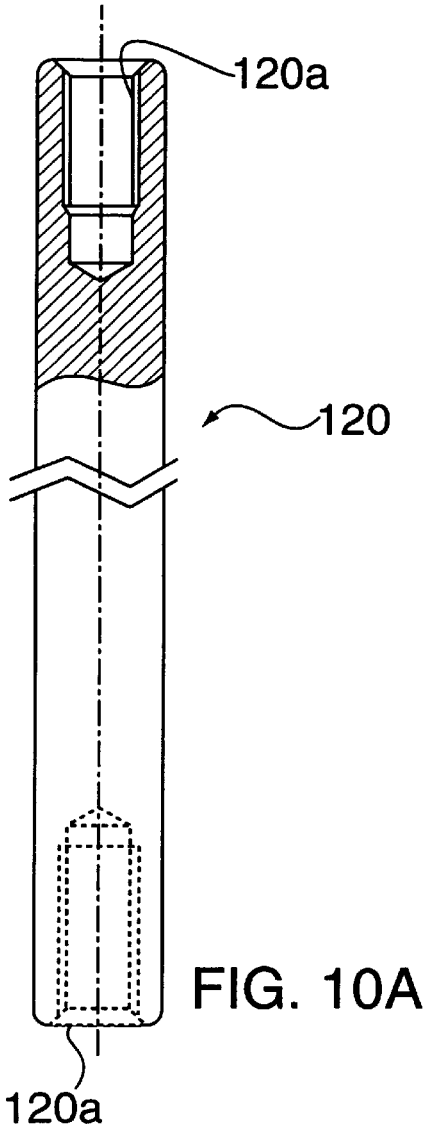
FIG. 10A is an elevational view, partially in cross-section of a crossbar for attachment between two frame members of the module of FIG. 1.
Figure 10K:
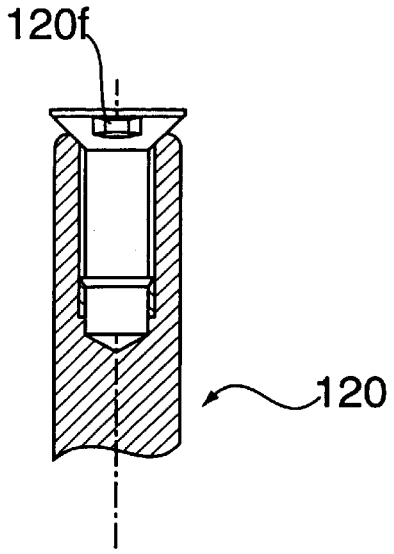
FIG. 10K is a cross-sectional view of a screw for holding the locking ring of FIG. 10I onto the end of the crossbar of FIG. 10A, as shown in FIG. 10B.
Figure 10B:
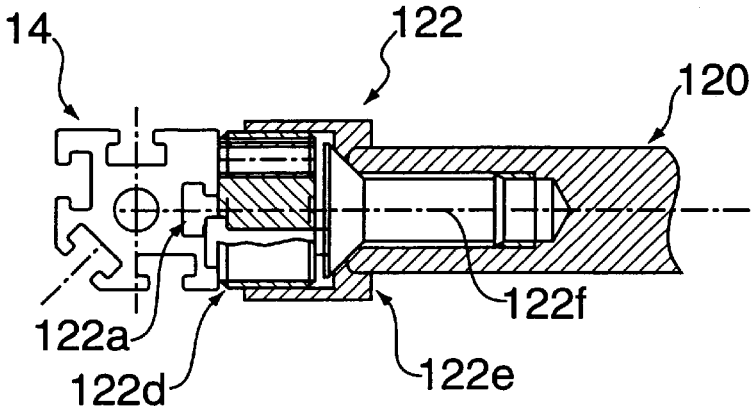
FIG. 10B is a partial cross-sectional view of the crossbar of FIG. 10A shown connected to a frame member.

As shown in FIGS. 10A, 10B, and 10K, the crossbar 120 has two axial end bores 120*a*, for a purpose to be discussed hereinafter. Crossbar 120 preferably is made of aluminum, but can also be made of other materials of suitable strength to serve as a crossbar.

Figure 10D:
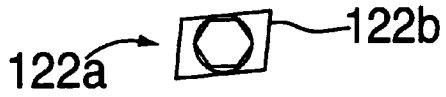
FIG. 10D is a top plan view of the screw of FIG. 10C.
Figure 10C:
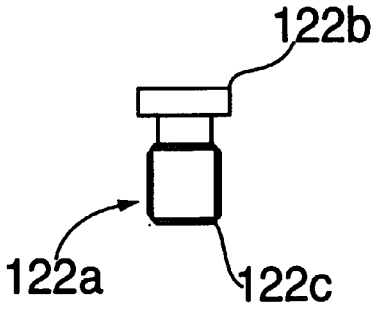
FIG. 10C is a side elevational view of a screw for locking the crossbar of FIG. 10B into the channel of a frame member as shown in FIG. 10B.
Figure 10E:
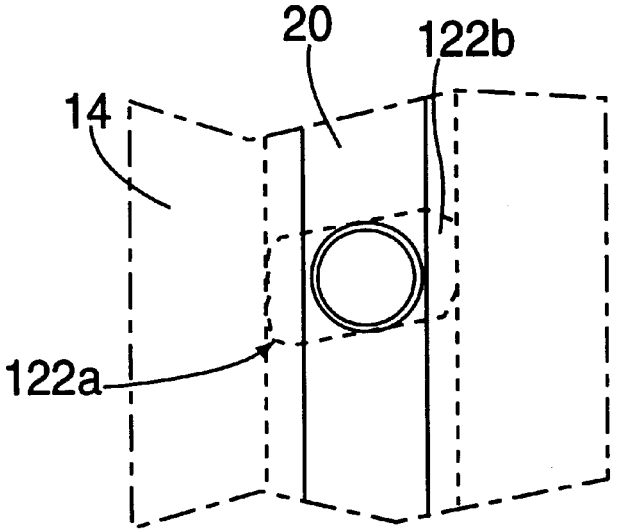
FIG. 10E is an end elevational view showing the screw of FIG. 10C inserted into a channel.

A screw 122*a* is provided for locking the crossbar 120 into the channel 20. As shown in FIGS. 10C–10D, the screw 122*a* has a trapezoidal head 122*b* and a threaded shaft 122*c*, the head 122*b* being dimensioned to be insertable into and removable from the channel 20 when oriented in one direction and locked into the channel 20 when rotated 90° from that direction.

Figure 10F:
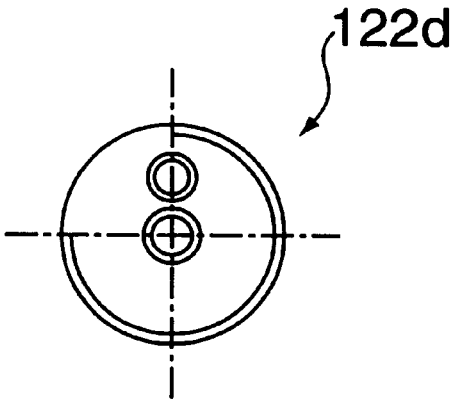
FIG. 10F is an end elevational view of a threaded disk to be screwed onto the shaft of the screw of FIG. 10C, as shown in FIG. 10B.
Figure 10G:
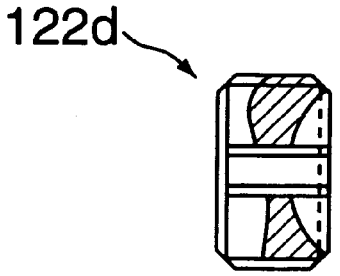
FIG. 10G is a cross-sectional view of the disk of FIG. 10F, taken along line 10G—10G of FIG. 10F.
Figure 10H:
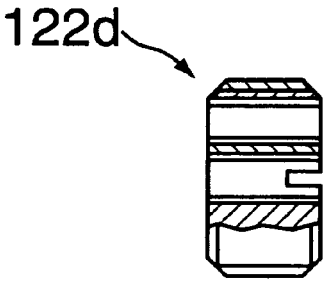
FIG. 10H is a cross-sectional view of the disk of FIG. 10F, taken along line 10H—10H of FIG. 10F.
Figure 10I:
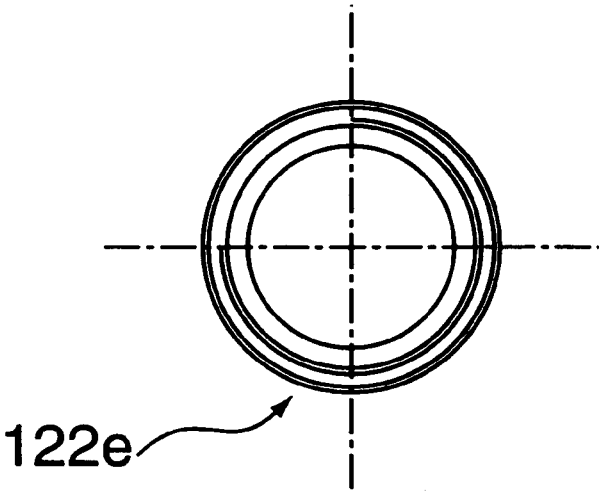
FIG. 10I is a locking ring for locking the disk of FIG. 10F onto the crossbar of FIG. 10A, as shown in FIG. 10B.
Figure 10J:
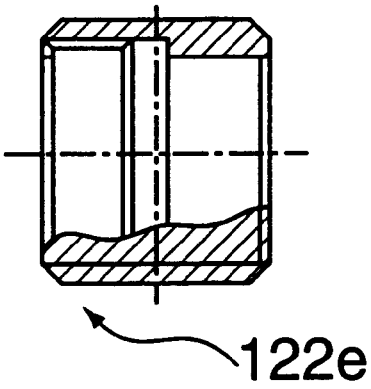
FIG. 10J is a cross-sectional view of the locking ring of FIG. 10I, taken along line 10J—10J of FIG. 10I.

FIGS. 10F–10H show a threaded disk 122*d*, which can be made of brass, to be screwed onto the shaft of the screw of FIG. 10C, as shown in FIG. 10B. FIG. 10I in turn shows a locking ring 122*e* for locking the disk 122*d* onto the crossbar 120, as shown in FIG. 10B, and the locking ring 122*e* is held in place against the end of the crossbar 120 by a flat head screw 122*f* screwed into the bore 120*a*, as shown in FIGS. 10B and 10K. Locking ring 122*e* can be made of aluminum.

As will be appreciated by those of skill in the art, the locking assembly 122 can also be used to position the crossbar 120 between the frame members 14 of two spaced modules 10, in the same way as between two parallel frame members 14 of a module 10.

Figures 11A, 11B:
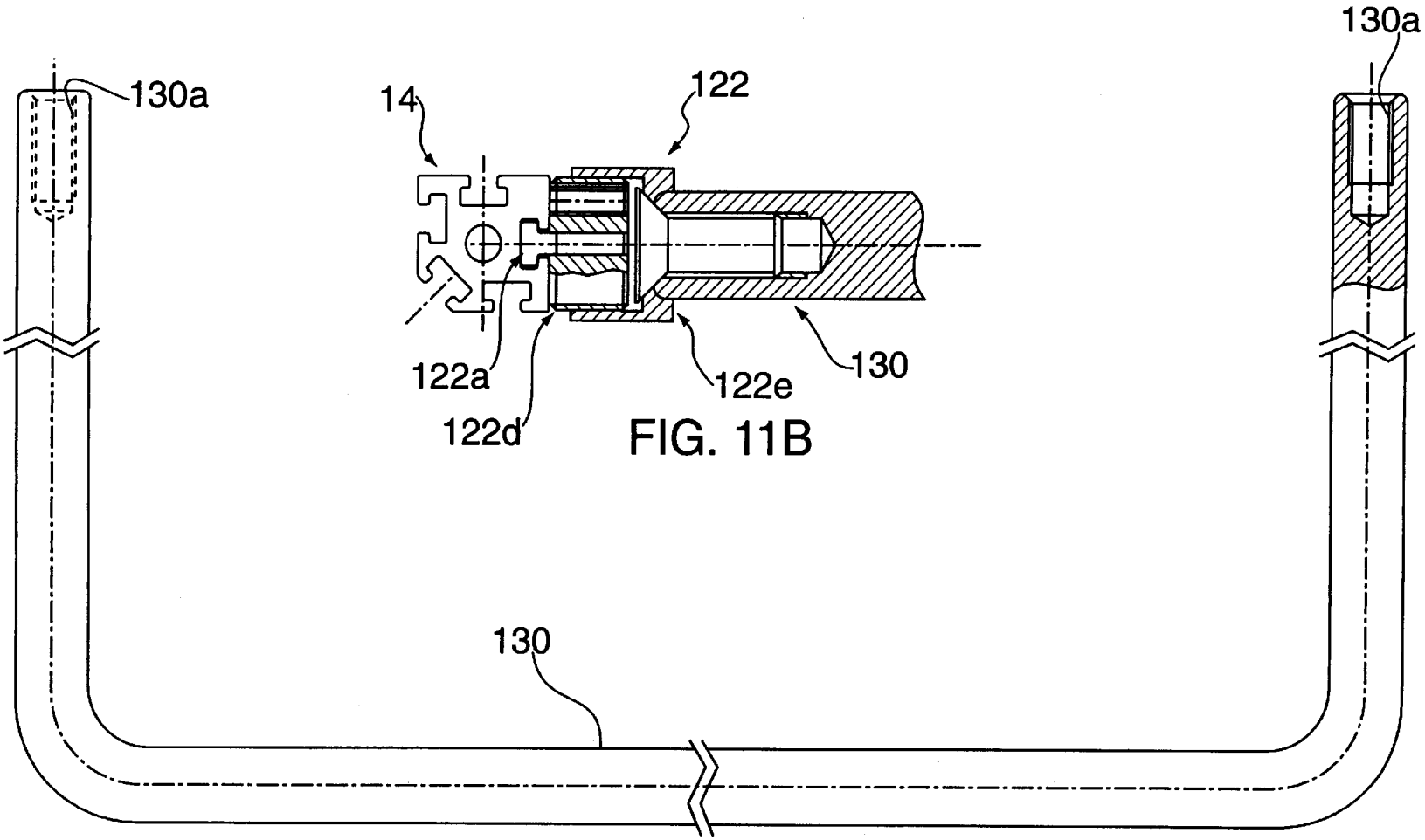
FIG. 11A is an elevational view, partially in cross-section of a U-shaped hanging rod for attachment between two frame members of the module of FIG. 1.
FIG. 11B is a partial cross-sectional view of the hanging rod of FIG. 11A shown connected to a frame member.

Referring now to FIGS. 11A and 11B, there is shown a U-shaped hanging rod 130 and a locking assembly 122 for locking the hanging rod 130 in place in the channels 20 of the frame members 14 of a module 10, the locking assembly 122 being the same as that described with reference to FIGS. 10B–10K. Like crossbar 120, hanging rod 130 has axial end bores 130*a*, each of which receives a screw 122*f* which locks the locking assembly 122 in place, and can be made of the same materials as the crossbar 120. Also as with the crossbar 120, the locking assembly 122 can be used to position the hanging rod 130 between the frame members 14 of two spaced modules 10, in the same way as between two parallel frame members 14 of a module 10.

Figure 12:
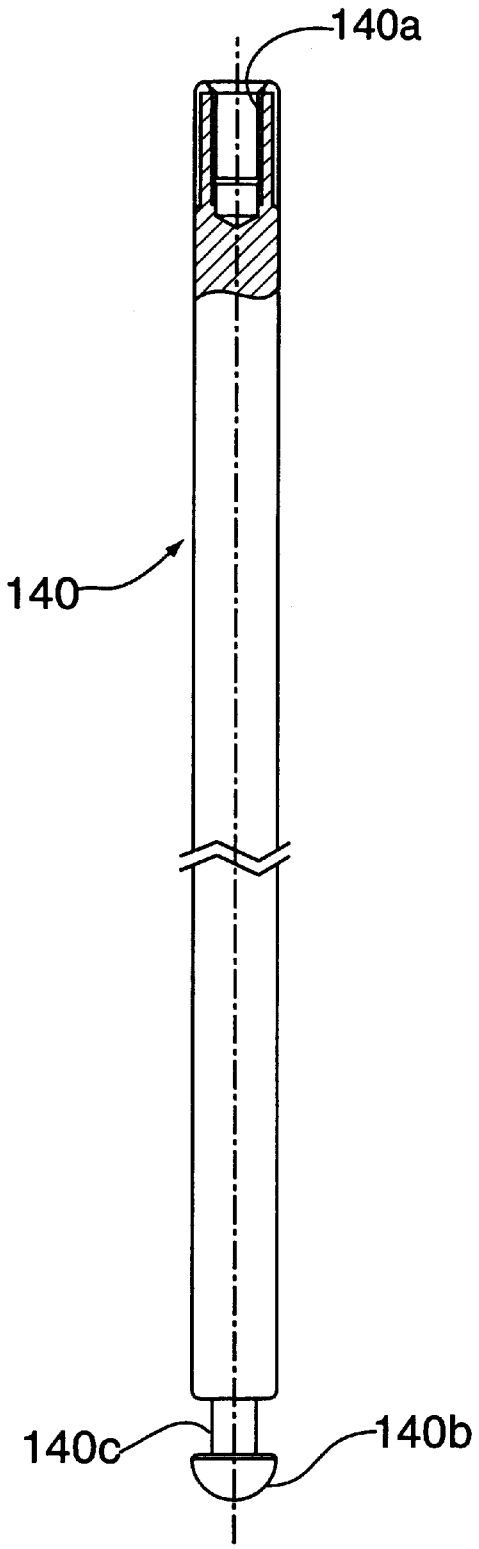
FIG. 12 is an elevational view, partially in cross-section of a faceout rod for attachment to a frame member of the module of FIG. 1.

FIG. 12 shows a faceout rod 140 for attachment to a frame member 14 of the module 10 using the locking assembly 122 described with reference to FIGS. 10B–10K. Faceout rod 140 has an axial end bore 140*a* at one end, which receives a screw 122*f* which locks the locking assembly 122 in place. At its other end, faceout rod 140 has a knob 140*b*, which is connected to the body of the rod by a necked-in area 140*c*. Faceout rod 140 can also be made of the same materials as the crossbar 120.

As will be appreciated by those of skill in the art, the faceout rod 140 can be positioned in a channel 20 either facing the interior or the exterior of the module 10.

Referring now to FIGS. 13A–13E, there is shown a shelf assembly 150 for mounting on the faceout rod 140. The shelf assembly 150 comprises a shelf 152 and a mounting bracket 154 which holds the shelf 152. Both the shelf 152 and the mounting bracket can be made of aluminum, although it will be appreciated by those of skill in the art that other materials can be used.

The shelf 152 can be configured and dimensioned to fit within the interior of the module 10. The mounting bracket 154 is in the shape of an inverted, truncated cone, and has both an axial bore 154*a* and a transverse bore 154*b* at a right angle to the axial bore 154*a*. The transverse bore 154*b* is dimensioned to receive the faceout rod 140. The shelf 152 has a central, counterbored aperture 152*a*, enabling a flat head screw (not shown) to be inserted through the shelf and the axial bore 154*a* to secure the shelf 152 to the mounting bracket 154. The faceout rod 140 can also be provided with a transverse bore (not shown) in registration with the axial bore 154*a* of the mounting bracket 154, to enable the flat head screw to pass through, or the screw can be dimensioned to be tightened against the surface of the faceout rod 140.

Figure 13A:
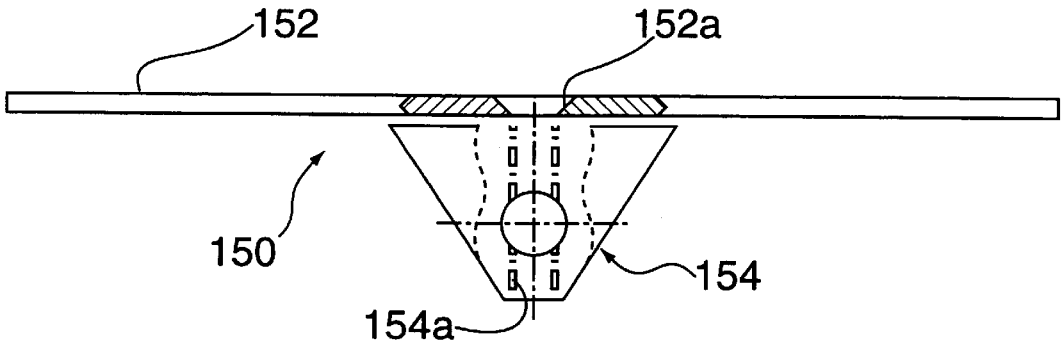
FIG. 13A is a side elevational view, partially in cross-section of a shelf assembly for mounting on the faceout rod of FIG. 12.
Figure 13B:
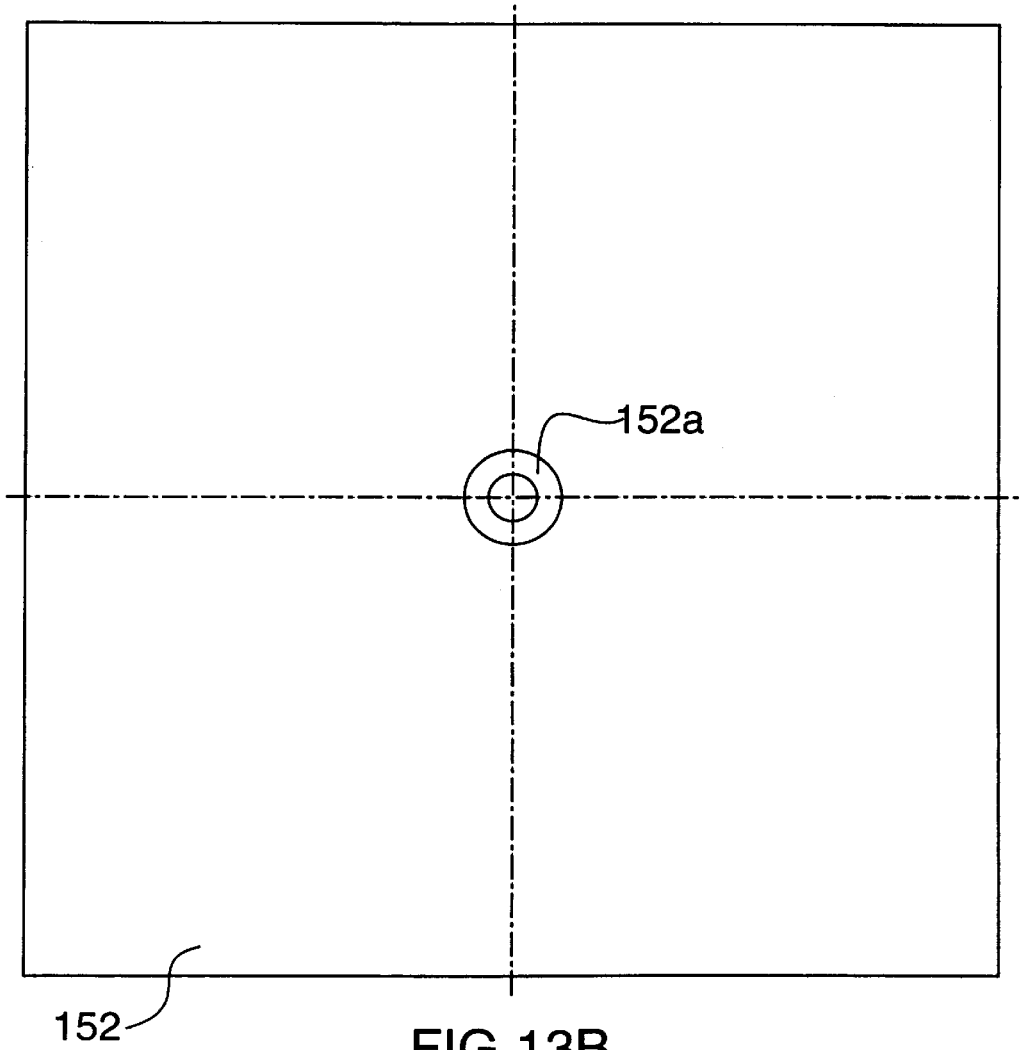
FIG. 13B is a top plan view of the shelf assembly of FIG. 13A.
Figure 13C:
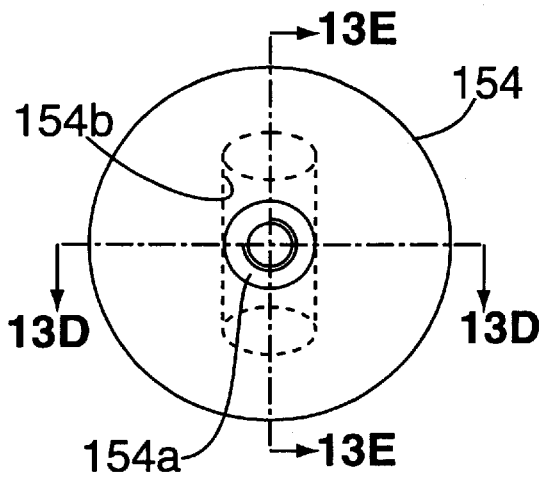
FIG. 13C is a top plan view of the mounting bracket of the shelf assembly of FIG. 13A.
Figure 13D:
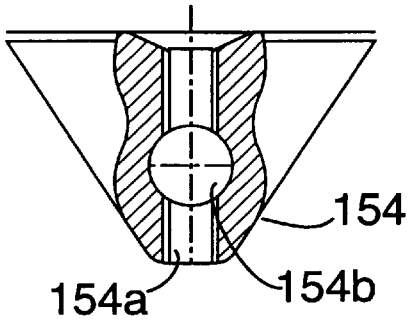
FIG. 13D is a cross-sectional view of the mounting bracket, taken along line 13D—13D of FIG. 13C.
Figure 13E:
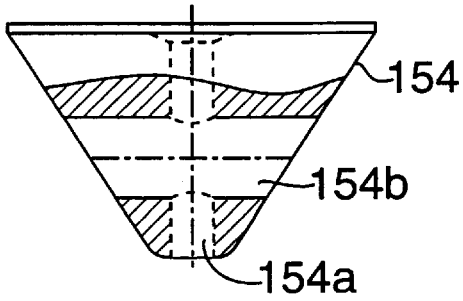
FIG. 13E is a cross-sectional view of the mounting bracket, taken along line 13E—13E of FIG. 13C.
Figure 13F:
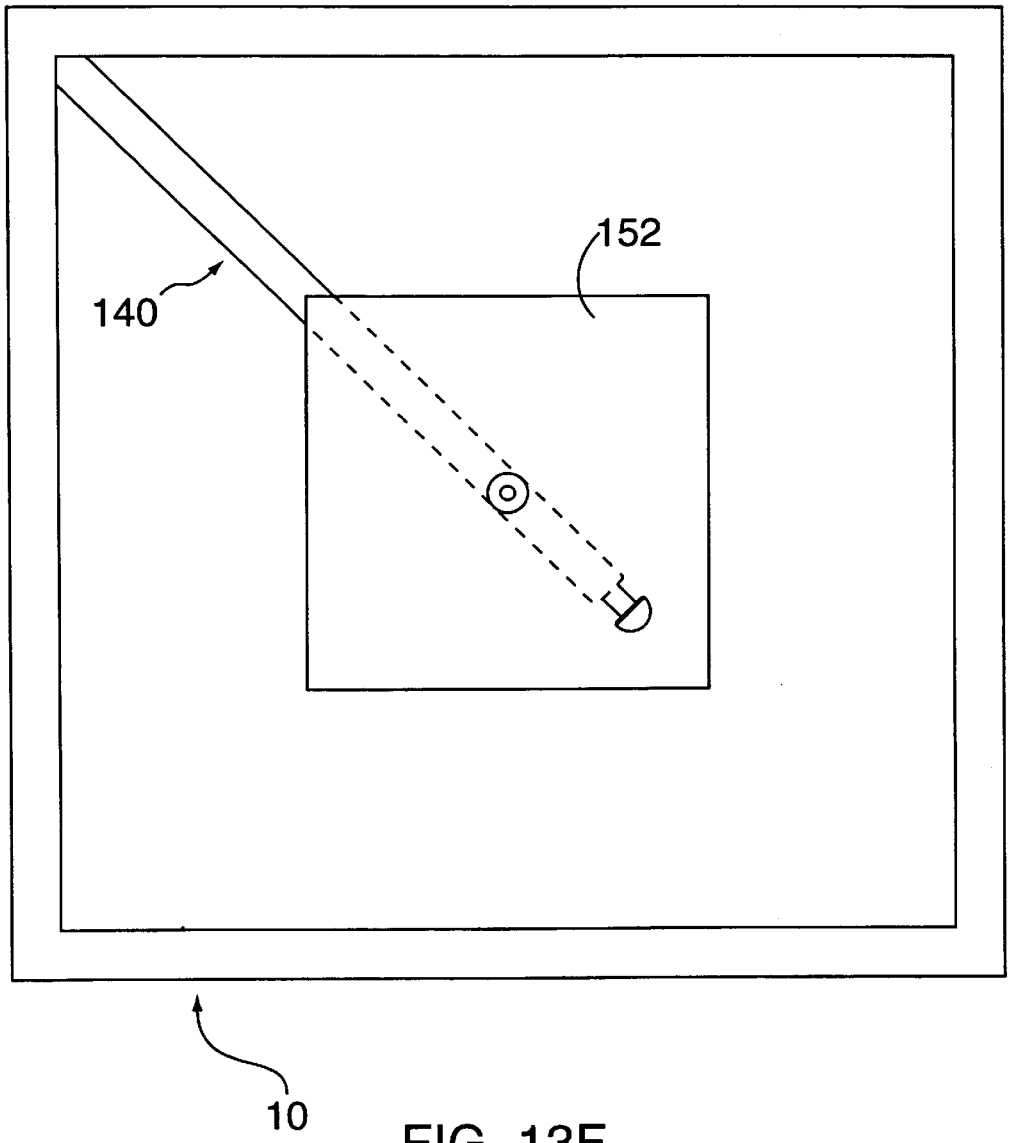
FIG. 13F is a top plan view of a module having the faceout rod of FIG. 12 attached thereto and the shelf assembly of FIG. 13B mounted on the faceout rod.

FIG. 13F shows a module 10 having the faceout rod 140 inserted into a corner channel 20*c* of a side frame member 14*b*, and the shelf assembly 150 mounted on the faceout rod 140.

Figure 14A:
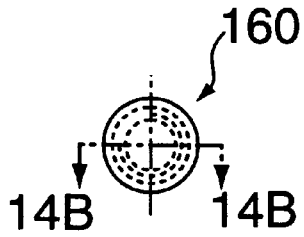
FIG. 14A is a top plan view of a shelf support pin for attachment to a frame member of the module of FIG. 1.
Figure 14B:
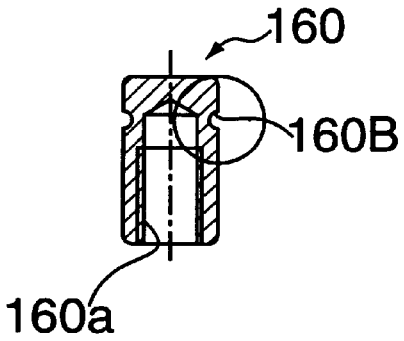
FIG. 14B is a cross-sectional view of the shelf support pin of FIG. 14A, taken along line 14B—14B of FIG. 14A.
Figure 14C:
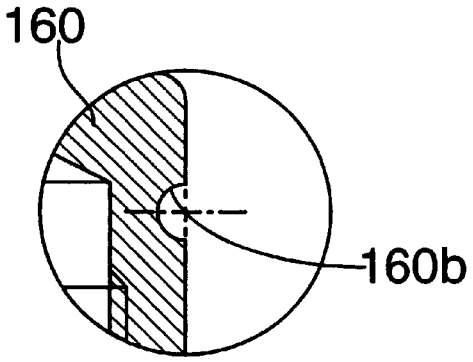
FIG. 14C is an enlargement of the circled area 14C of FIG. 14A.

FIGS. 14A–14C show a shelf support pin 160 for attachment to a frame member 14 of the module 10 using the locking assembly 122 described with reference to FIGS. 10B–10K. Shelf support pin 160 has an axial end bore 160*a* at one end, which receives a screw 122*f* which locks the locking assembly 122 in place. At its other end, shelf support pin 160 is provided with a radiused circumferential groove 160*b*. Four of these shelf support pins 160 can be inserted into the interior channels 20 of the side frame members 12*b* at the same level to provide support for a shelf in a conventional manner. The shelf support pin 160 can be made of aluminum or other suitable materials.

Figure 15D:
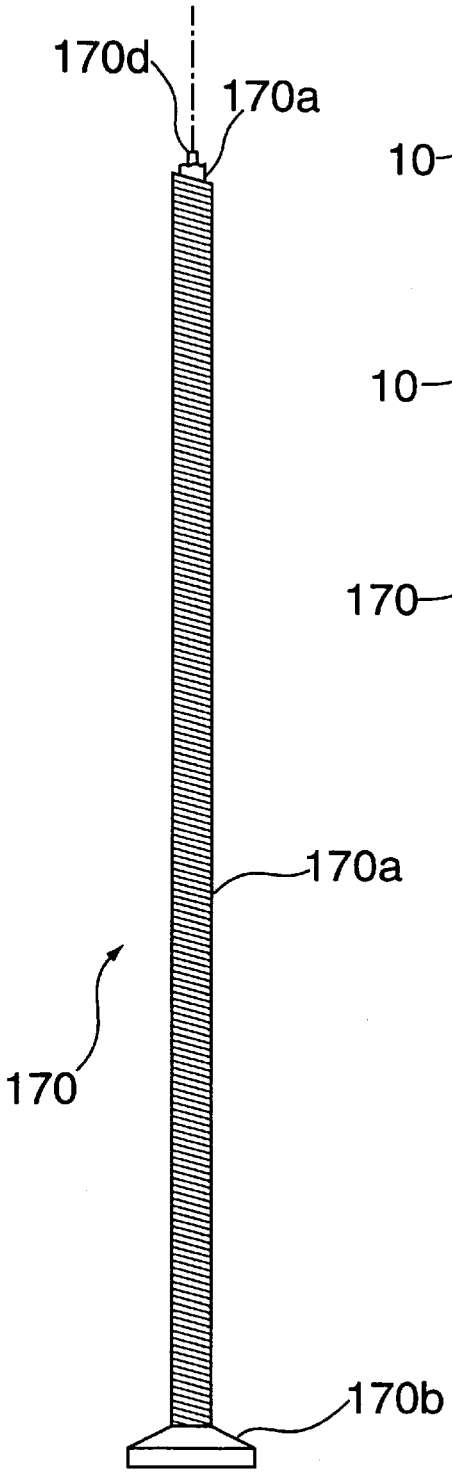
FIG. 15D is a side elevational view of one of the legs shown in FIG. 15C.
Figure 15A:
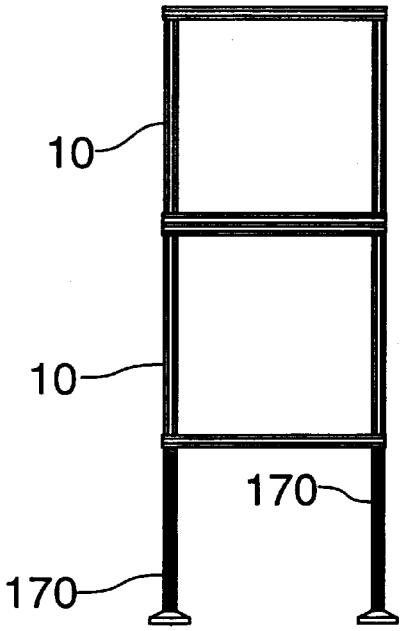
FIG. 15A is a side elevational view of a pair of modules of the type shown in FIG. 1, with legs attached to the bottom of the bottommost module.
Figure 15C:
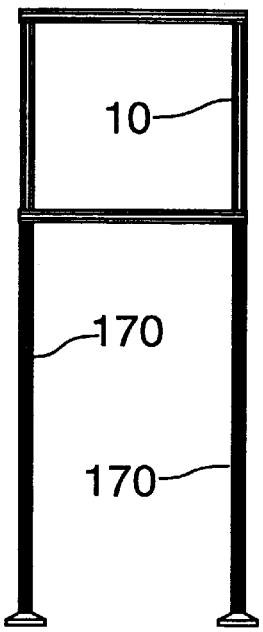
FIG. 15C is a side elevational view of a single module as shown in FIG. 1, with legs attached to the bottom of the module.
Figure 15B:
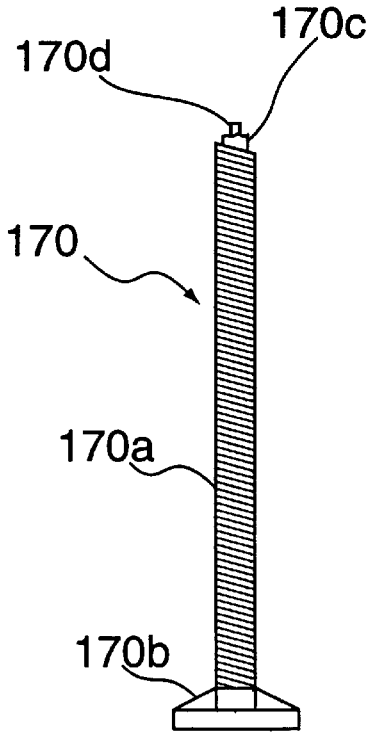
FIG. 15B is a side elevational view of one of the legs shown in FIG. 15A.

A module 10 can be mounted on legs 170 to raise it above floor level, as shown in FIGS. 15A and 15C. The height of the legs 170 used with a module 10 or a stack of modules will, as is conventional, depend upon the height to which it is desired to raise the module or stack of modules. Legs 170 of two different heights are shown in FIGS. 15A and 15B, and in FIGS. 15C and 15D, the legs 170 of FIG. 15A and 15B having a height equal to that of one module 10, and the legs 170 of FIGS. 15C and 15D having a height equal to that of two modules 10.

Other than their heights, the legs 170 are identical. Each leg 170 has a shaft portion 170*a*, a foot 170*b* at the bottom of the shaft portion 170*a*, and an integral screw 170*c* at the top of the shaft portion 170*a*. The screw 170*c* has substantially the same configuration as the screw 30 described in connection with FIGS. 3A and 3B, enabling the legs 170 to replace the screws 30 at the bottom of the module 10. Thus, the upper surface of the shaft portion 170*a* has an annular tapered lip 170*c* projecting from its upper surface for mating engagement with the tapered circumferential groove 40*c* provided in the bottom surfaces of the end frame members 14*a*; and an externally-threaded shaft portion 170*d* dimensioned for engagement with the internally-threaded bore 42 of the side frame members 14*b*.

Referring now to FIGS. 16A–16H, there is shown a cylindrical attachment rod 180 for attaching a centered crossbar 190 (to be described hereafter) to the exterior of a module 10. Attachment rod 180 has two end transverse bores and a center transverse bore 180*b*. The longitudinal axes of transverse bores 180*a* and 180*b* are parallel. Transverse bores 180*a* have constant diameters throughout their lengths; whereas transverse bore 180*b* has a first end having a first diameter and a second end having a second diameter greater than the first diameter, for a purpose to be described hereafter. Attachment rod 180 can be made from aluminum or other suitable materials.

Figure 16A:
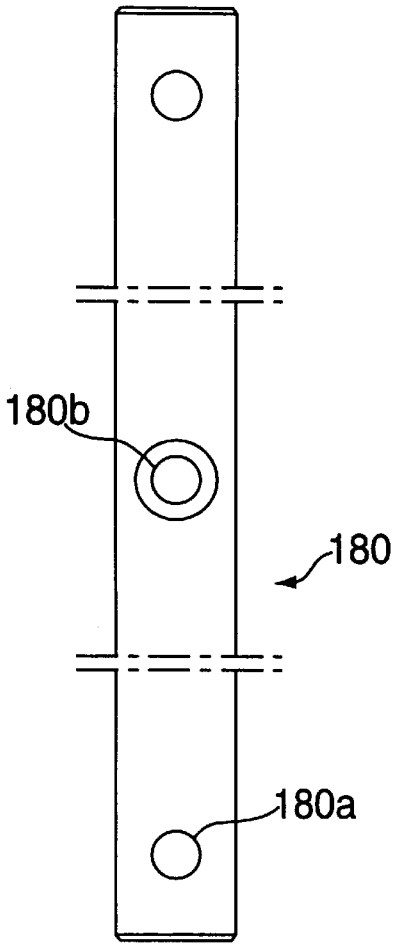
FIG. 16A is an elevational view of an attachment rod for attaching a centered crossbar to the exterior of the module of FIG. 1.
Figure 16B:
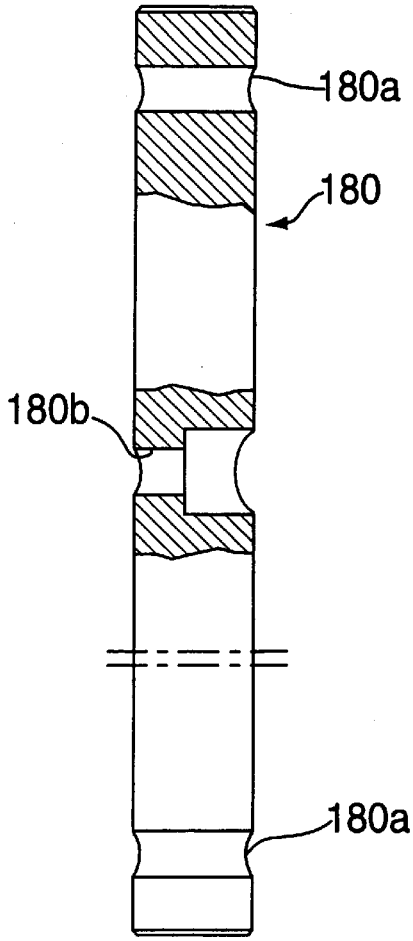
FIG. 16B is an elevational view, partially in cross-section, of the attachment rod of FIG. 16A, rotated 90°.
Figure 16C:
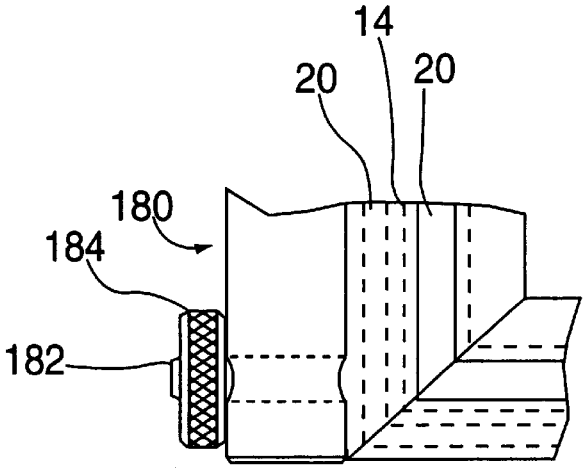
FIG. 16C is a partial elevational view of the attachment rod of FIG. 16A attached to the exterior of a module.
Figure 16D:
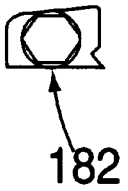
FIG. 16D is a top plan view of a screw for attaching the attachment rod to a frame member of the module.
Figure 16E:
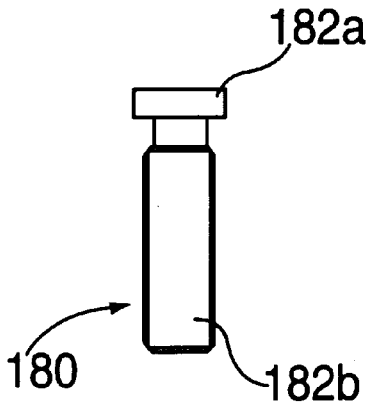
FIG. 16E is a cross-sectional view of the screw of FIG. 16D, taken along line 16E—16E of FIG. 16D.
Figure 16F:
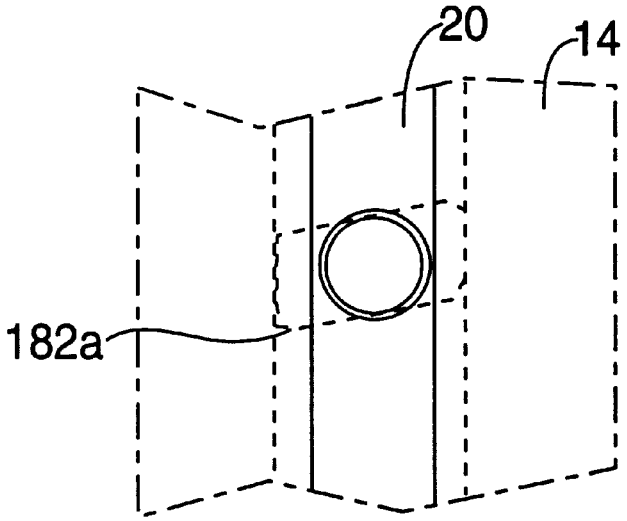
FIG. 16F is an end elevational view showing the screw of FIG. 16D inserted into a channel.
Figure 16G:
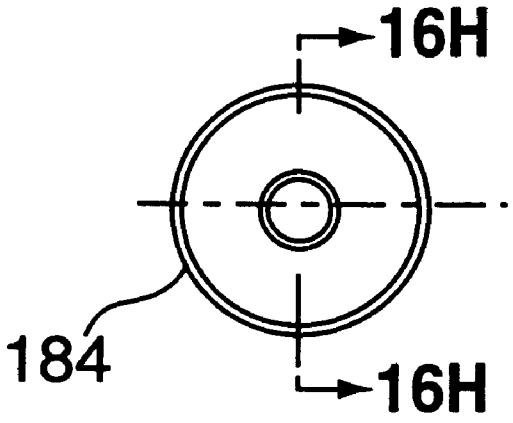
FIG. 16G is an top plan view of a threaded ring for holding the screw of FIG. 16D In place in the attachment rod of FIG. 16A.
Figure 16H:
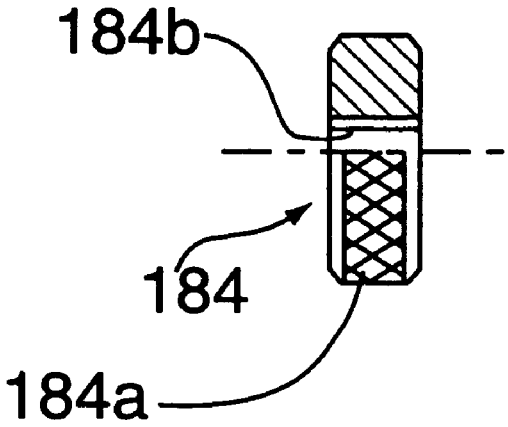
FIG. 16H is a cross-sectional view of the threaded ring of FIG. 16G, taken along line 16H—16H of FIG. 16G.

Attachment rod 180 is attached to a frame member using a pair of screws 182, shown in FIGS. 16D–16F, inserted through end bores 180*a* and into a channel 20 in the manner shown in FIG. 16C. As shown in FIGS. 16D–16F, each screw 182 has a trapezoidal head 182*a* and a threaded shaft 182*b*, the head 182*a* being dimensioned to be insertable into and removable from the channel 20 when oriented in one direction and locked into the channel 20 when rotated 90° from that direction.

A ring 184 having a knurled circumference 184*a* and an internally-threaded bore 184*b* engages the exposed end of the threaded shaft 182*b*, is provided for securing the attachment rod 180 in place on screws 182 and against the frame member 14 of the module 10. The ring 184 can also be made of aluminum.

Figure 17A:
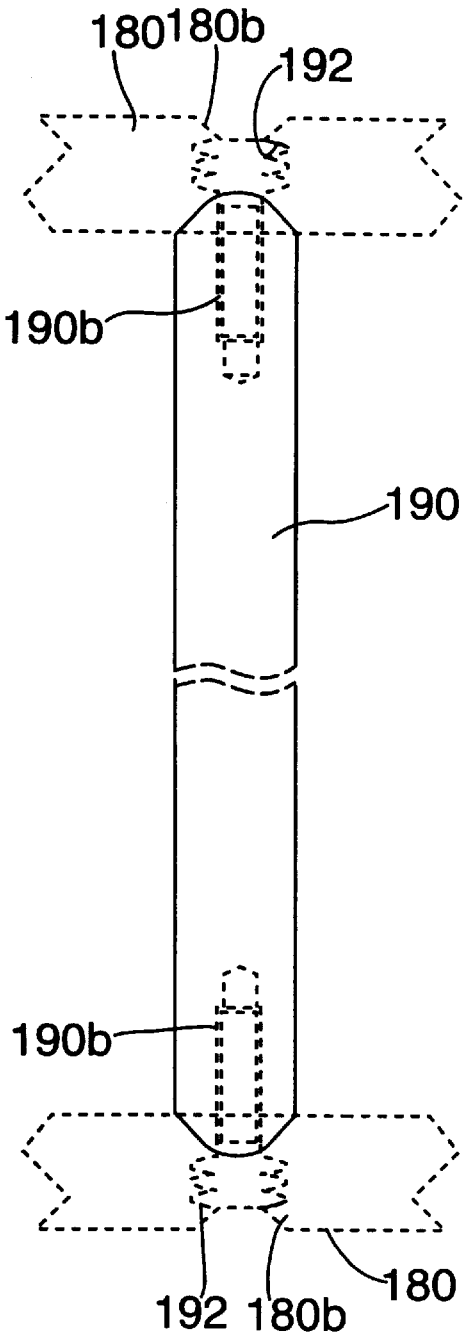
FIG. 17A is an elevational view of a crossbar for attachment between two attachment rods of the type shown in FIG. 16A, with the attachment rods being shown in dashed lines.
Figure 17B:
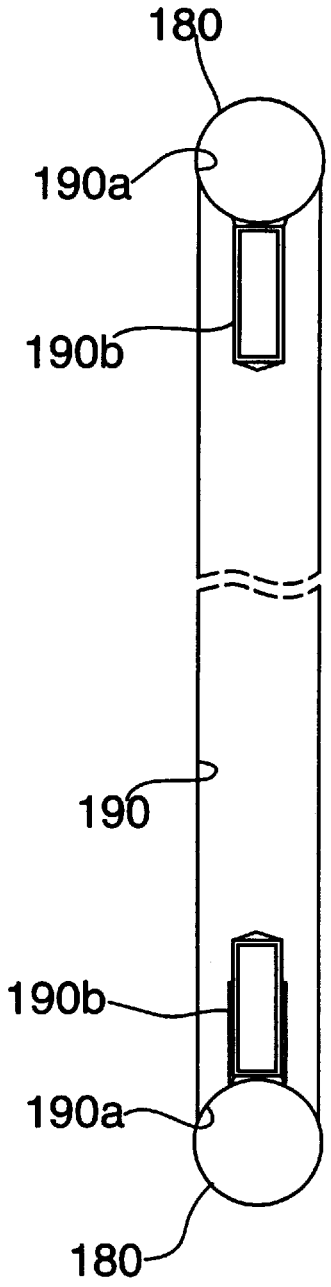
FIG. 17B is an elevational view, partially in cross-section, of the attachment rod of FIG. 16A, rotated 90°, with the attachment rods being shown in dashed lines.

A pair of attachment rods 180 can be attached to a respective pair of spaced modules 10 to receive a centered cylindrical crossbar 190 between them, as shown in FIGS. 17A and 17B. The crossbar 190 has semi-cylindrical channels 190*a* formed at either end, dimensioned to engage the side surfaces of the two attachment rods 180; and internally-threaded axial bores 190*b* extending inwardly from the channels 190*a*. The crossbar 190 is held in place between the two attachment rods 180 by two screws 192 inserted into the center bores 180*b* of the attachment rods 180 and the axial bores 190*b* of the crossbar 190, the larger diameter portion of each center bore 180*b* being dimensioned to receive the head of a screw 192; and the smaller diameter portion of each center bore being the same diameter as its corresponding axial bore 180*b* and being dimensioned to receive the shaft of a screw 192. The crossbar 190 can also be made of aluminum or other suitable materials.

Figure 18B:
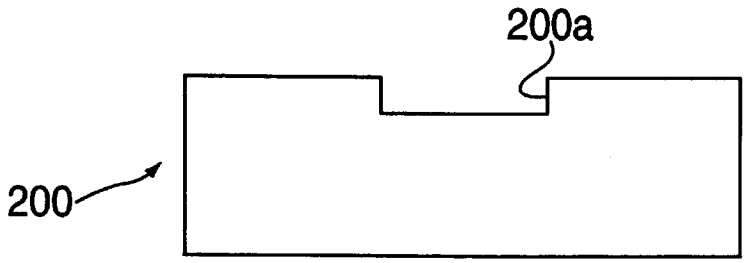
FIG. 18B is a front elevational view of one of the drawers shown in FIG. 18A.
Figure 18C:
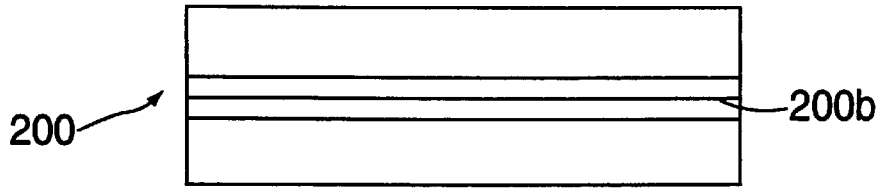
FIG. 18C is a side elevational view of the drawer of FIG. 18B.
Figure 18A:
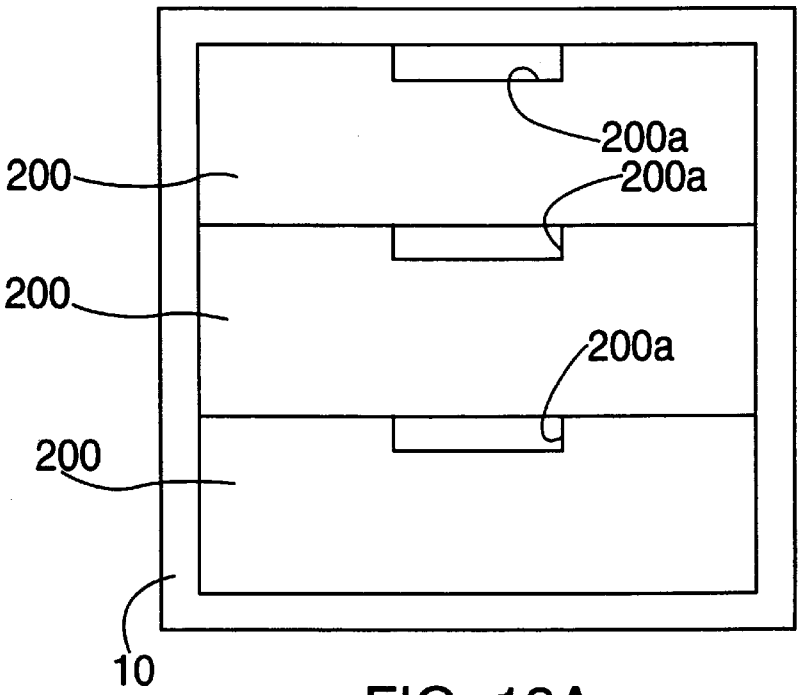
FIG. 18A is a front elevational view of the module of FIG. 1 with a set of drawers therein.

As shown in FIG. 18A, a set of drawers 200 can be installed in a module 10. In one embodiment, shown in FIGS. 18B–18C, each drawer 200 has a cutout 200*a* at its front top for use as a drawer pull, and at its sides, conventional ball bearing and wheel type drawer slides 200*b*. Conventional mating slides (not shown) for engaging the slides 200*b* can be mounted between the side frame members 14*b* using an attachment rod similar to that shown in FIGS. 16A–16B, but having the mating slides attached to the sides.

Figure 19B:
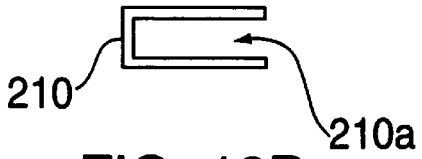
FIG. 19B is a top plan view of one of the panel holders of FIG. 19A.
Figure 19A:
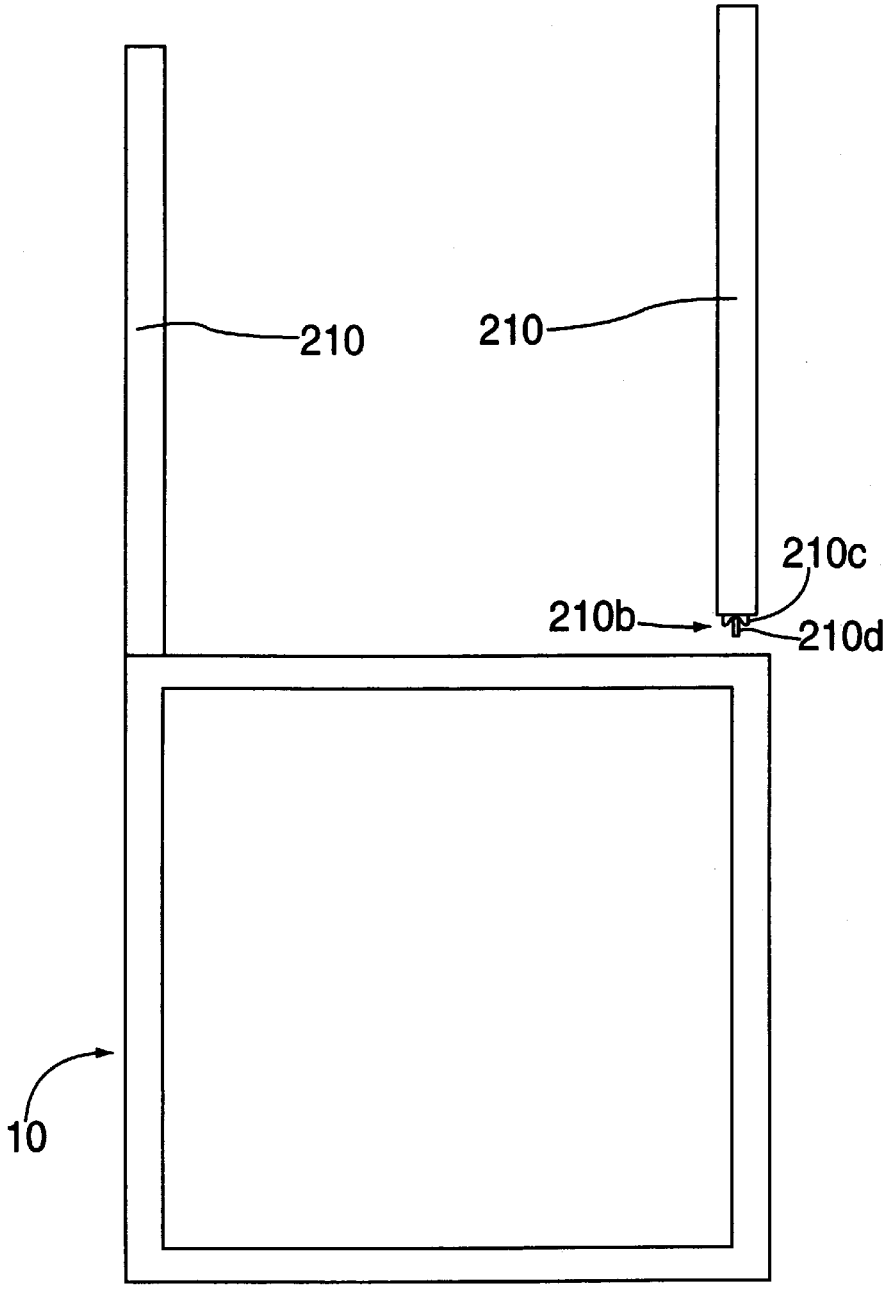
FIG. 19A is a front elevational view, partially-exploded, of the module of FIG. 1 with a pair of panel holders.

As shown in FIGS. 19A–19B, a pair of panel holders 210 can be installed on the top of a module 10, to hold a display panel P. Each panel holder 210 has a C-shaped cross-section, one edge of the panel P fitting into the channel 210*a* defined by the "C."

Each panel holder 210 also has an integral screw 210*b* at its bottom end. The screw 210*b* has substantially the same configuration as the screw 30 described in connection with FIGS. 3A and 3B, enabling the panel holders 210 to replace the screws 30 at the top of the module 10. Thus, the lower surface of the panel holder 210 has a circumferential tapered lip 210*c* projecting from its lower surface for mating engagement with the tapered circumferential groove 40*c* provided in the upper surfaces of the end frame members 14*a*, and an externally-threaded shaft portion 210*d* dimensioned for engagement with the internally-threaded bore 42 of the side frame members 14*b*.

Figure 20C:
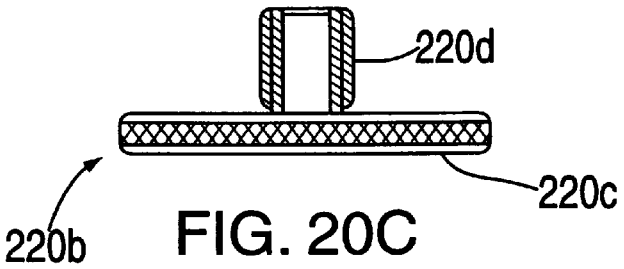
FIG. 20C is a side elevational view, partially in cross-section, of the male fitting of FIG. 20B.
Figure 20B:
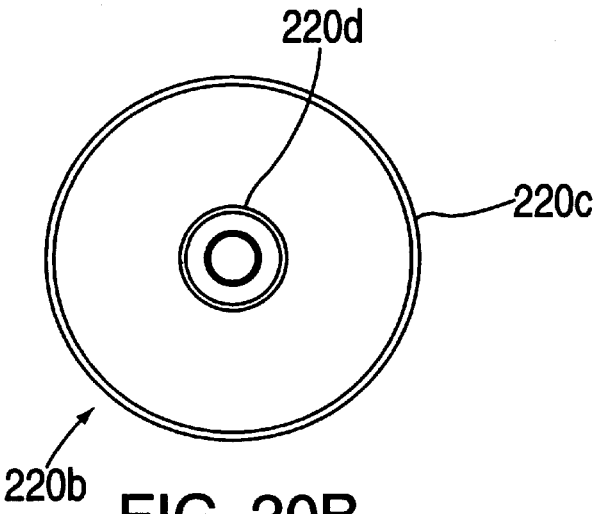
FIG. 20B is an end plan view of the male fitting of the connector of FIG. 20A.
Figure 20A:
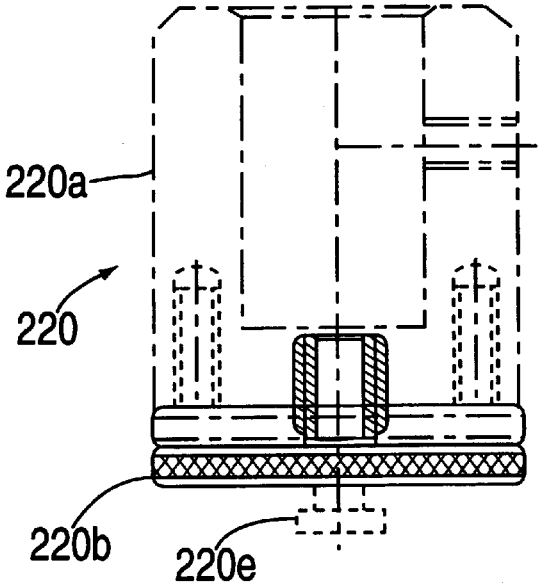
FIG. 20A is a side elevational view, partially in cross-section, of a connector for connecting various devices to a frame member.

As will be appreciated by those of skill in the art, it may be desirable to attach numerous other ancillary accessories and articles to a module 10. A universal connector 220 therefore is provided, as shown in FIG. 20A. Referring to FIGS. 20A–20C, the connector 220 includes a bushing 220*a* for receiving the end of the article to be to a frame member 14. The bushing 220*a* has an axial bore at one end dimensioned to receive an end of the article, and another axial bore at the other end dimensioned to receive a male fitting 220*b*, shown in FIGS. 20B and 20C. The bore which receives the end of the article can be threaded or unthreaded, depending upon the application. The bore which receives the male fitting 220*b* is internally threaded.

The male fitting 220*b* has a head 220*c* which is knurled around its circumference and a shaft 220*d* which is externally threaded. Further, an internally-threaded axial bore extends through the head 220*c* and the shaft 220*d* for receiving a screw 220*e* for attaching the connector 220 to a frame member 14 of the module 10. As shown in FIGS. 20F–20H, the screw 220*e* has a trapezoidal head 220*f* and a threaded shaft 220*g*, the head 220*f* being dimensioned to be insertable into and removable from the channel 20 when oriented in one direction and locked into the channel 20 when rotated 90° from that direction.

Figure 20E:
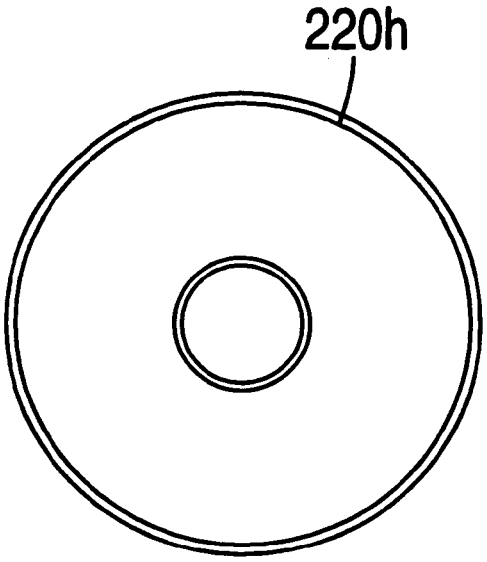
FIG. 20E is a side elevational view, partially in cross-section, of the adjusting ring of FIG. 20D.
Figure 20D:
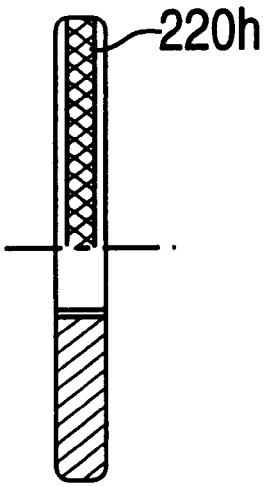
FIG. 20D is an end plan view of the adjusting ring for the male fitting of the connector of FIG. 20A.
Figure 20F:
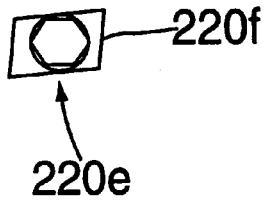
FIG. 20F is a top plan view of the screw for attaching the connector to a frame member of the module.
Figure 20G:
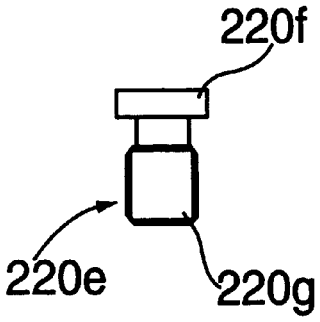
FIG. 20G is a cross-sectional view of the screw of FIG. 20F, taken along line 20G—20G FIG. 20F.
Figure 20H:
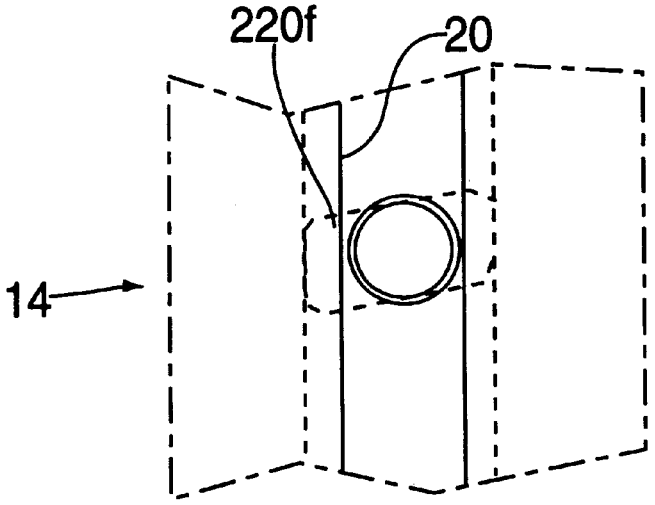
FIG. 20H is an end elevational view showing the screw of FIG. 20F inserted into a channel.

The position of the male connector 220*b* relative to the bushing 220*a* is conventionally adjusted using an adjusting ring 220*h*, shown in FIGS. 20D and 20E. Adjusting ring 220*h* is also knurled on its circumference, and has an internally-threaded axial bore dimensioned to receive the shaft 220*g* of the screw 220*e*.

Both the male fitting 220*b* and the adjusting ring 220*h* can be made of aluminum or other suitable materials.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described

What is claimed is:

1. A display module comprising at least one modular display frame, said at least one modular frame comprising:

first and second sets of four opposing lateral frame members defining opposing first and second, rectangular end frames, each of said lateral frame members having first and second end surfaces; the first end surface being in contact with a mating end of the adjacent lateral frame member juxtaposed so as to form the four opposing corners of the rectangular end frames, and having a depression formed therealong, and the second end surface extending transverse to the first end surface and having an arcuate groove formed thereon coaxial with the depression, the adjacent lateral frame members being so juxtaposed that the arcuate groove and arcuate depression on each of the two adjacent lateral frame members interconnect to form a circular groove at each corner and corner opening extending entirely through the corner, one end of the opening being outlined by the circular groove;

a longitudinal frame member extending perpendicularly between said opposing corners, respectively, of said first and second end frames, each of said longitudinal frame members having opposed ends and an internally-threaded bore extending inwardly from each of said ends, the longitudinal frame member being in contact with one end frame at each end and so juxtaposed that the internally threaded bore is coaxial with, but axially displaced from the arcuate groove of the respective end frame, adjacent the opposite end of the cover opening;

a fastener fastening each of said opposing corners to a respective one of said longitudinal frame members, each said fastener having a head and an externally-threaded shaft, each head having a projecting lip corresponding to and engaging the circular groove formed in said outer surface of the respective corners, and said externally-threaded shaft engaging said internally-threaded bore in said end of said longitudinal frame member extending from said corner, simultaneously locking together the lateral frame members forming the corner and securing the corner of the end frame to the longitudinal frame member;

each of said lateral and longitudinal frame members having at least one surface having formed therein a channel designed to matingly receive and secure a connecting member, the channel extending the full length of the member from corner to corner.

2. The display module of claim 1, wherein the first end surface extends transverse to the longitudinal axis of the frame member and perpendicular to the second end surface, the second end surface extending parallel to the longitudinal axis of the frame member.

3. The display module of claim 1, further comprising connecting strips having I-shaped cross-sections sized and configured to be matingly received in said channels for connecting at least two display frames together.

4. The display module of claim 3, wherein said connecting strips are made of a flexible and resilient material.

5. The display module of claim 1, wherein said display module comprises at least two of said display frames adjacent each other, and further comprises connecting strips having I-shaped cross-sections sized complementary in configuration to a pair of opposed channels, said connecting strips being matingly received in said channels for connecting said at least two display frames together.

6. The display module of claim 5, wherein said connecting strips are made of a flexible and resilient material.

7. The display module of claim 1, further comprising;

a connector configured to be selectively lockable into said channels; and an auxiliary device attached to said display frame by said connector.

8. The display module of claim 7, wherein said auxiliary device is selected from the group consisting of crossbars, hang rods, legs, shelves, panels, doors, and drawers.

9. A display module of claim 1, further comprising a plurality of legs raising said display module above the level of a support surface, each of said legs comprising a shaft portion having an upper surface, an annular tapered lip projecting from said upper surface for mating engagement with one of said circular grooves and an externally-threaded shaft projecting from said upper surface radially inward of said annular tapered lip, said externally-threaded shaft being dimensioned for engagement with said internally-threaded bore in one of said longitudinal frame members, said annular tapered lip and said externally-threaded shaft forming one of said fasteners fastening a corner of one of said rectangular frames to one of said longitudinal frame members.

10. A display module of claim 1, wherein said frame members having four perpendicular sides which are each perpendicular to at least one of the other perpendicular sides and one mitred side defining a plane transverse to and extending between two of the perpendicular sides, said frames and said frame members have longitudinal channels formed along each side and said channels being identical in size and configuration and having a T-shaped cross-section, being designed to hold accessories having matching T-shaped heads.

11. The display module of claim 1, wherein each of said end frame members and said longitudinal frame members has a substantially square cross-section, first, second, third, and fourth sides and an interior-facing corner, and first, second, third, fourth, and fifth channels of T-shaped cross-section respectively interrupting said first, second, third, and fourth sides and said corner, all of said channels having identical dimensions.

12. The display module of claim 11, wherein said first side is adjacent said second and fourth sides and opposite said third side, and said interior corner is between said third and fourth sides; and wherein each said frame member has a center, a first edge between said first and fourth sides, a second edge between said first and second sides, and a third edge between said second and third sides, said first and second channels being formed in said first and second sides centered between said first and second edges and between said second and third edges, and said third and fourth channels being adjacent said first and third edges and between said second and third sides, respectively, and said fifth channel being formed at said corner between said third and fourth sides, one side edge of said second channel aligning with the center line of said first channel, and each frame member being symmetric about a diagonal plane through said second edge and said center.

13. The display module of claim 12, further comprising connecting strips having I-shaped cross-sections sized and configured to be matingly received in said channels for connecting at least two display frames together.

14. The display module of claim 13, wherein said connecting strips are made of a flexible and resilient material.

15. The display module of claim 12, wherein said display module comprises at least two of said display frames adjacent each other, and further comprises connecting strips having I-shaped cross-sections sized complementary in configuration to a pair of opposed channels, said connecting strips being matingly received in said channels for connecting said at least two display frames together.

16. The display module of claim 15, wherein said connecting strips are made of a flexible and resilient material.

17. A display module comprising at least one modular display frame, said at least one modular frame comprising:

first and second sets of opposing lateral frame members defining opposing first and second planar end frames, each of said planar end frames having a plurality of opposing corners, each of said frames having a closed arcuate groove formed on an an outer surface of each corner thereof and a concentric corner opening wholly within the groove and extending through the frame transverse to the plane of the end frame, a longitudinal frame member extending perpendicularly between said opposing corners, respectively, of said first and second end frames, each of said longitudinal frame members having opposed ends and an internally-threaded bore extending inwardly from each of said ends;

a fastener fastening each of said opposing corners to a respective one of said longitudinal frame members, each said fastener having a head and an externally-threaded shaft, each head having a projecting lip corresponding to and engaging said closed arcuate groove formed in said outer surface of each of said corners, and said externally-threaded shaft extending through the respective corner opening and engaging said internally-threaded bore in said end of said longitudinal frame member extending from said corner, simultaneously locking together the lateral frame members forming the corner and securing the corner to the longitudinal frame member;

a connector configured to be selectively lockable into said channels; and an auxiliary device attached to said display frame by said connector, wherein said auxiliary device has an attachment end having an axial bore formed therein;

and wherein said connector comprises a screw having a trapezoidal head and a threaded shaft, said threaded shaft being insertable into said axial bore with said trapezoidal head projecting outwardly of said attachment end, and said head being dimensioned to be insertable into and removable from one of said channels when oriented in one direction and locked into said channel when rotated 90° from said one direction.

18. The display module of claim 17, wherein said auxiliary device comprises a rod, and wherein said display module further comprises a shelf assembly for mounting on said rod, said shelf assembly comprising:

a shelf having an aperture therethrough;

a mounting bracket for mounting said shelf to said rod, said mounting bracket being in the shape of an inverted, truncated cone, and having an axial bore and a transverse bore at a right angle to said axial bore, said transverse bore being dimensioned to receive said rod; and a fastener for insertion through said aperture in said shelf and into said axial bore of said mounting bracket for fastening said shelf to said mounting bracket.

19. A display module comprising at least one modular display frame, said at least one modular frame comprising:

first and second sets of opposing lateral frame members defining opposing first and second planar end frames, each of said planar end frames having a plurality of opposing corners, each of said frames having a closed arcuate groove formed on an an outer surface of each corner thereof and a concentric corner opening wholly within the groove and extending through the frame transverse to the plane of the end frame, a longitudinal frame member extending perpendicularly between said opposing corners, respectively, of said first and second end frames, each of said longitudinal frame members having opposed ends and an internally-threaded bore extending inwardly from each of said ends;

a fastener fastening each of said opposing corners to a respective one of said longitudinal frame members, each said fastener having a head and an externally-threaded shaft, each head having a projecting lip corresponding to and engaging said closed arcuate groove formed in said outer surface of each of said corners and said externally-threaded shaft extending through the respective corner opening and engaging said internally-threaded bore in said end of said longitudinal frame member extending from said corner, simultaneously locking together the lateral frame members forming the corner and securing the corner to the longitudinal frame member;

and a panel assembly for insertion into said display frame, said panel assembly comprising:

a panel; and at least two panel holders, each said panel holder having a slot at a first end thereof for receiving an edge of said panel and a spring-loaded bearing at a second end thereof, said spring-loaded bearing being insertable into one of said channels and having an adjustable tension permitting said panel holder to be retracted easily for insertion and removal from said channel.

20. A display module comprising at least one modular display frame, said at least one modular frame comprising:

first and second sets of opposing lateral frame members defining opposing first and second planar end frames each of said planar end frames having a plurality of opposing corners, each of said frames having a closed arcuate groove formed on an an outer surface of each corner thereof and a concentric corner opening wholly within the groove and extending through the frame transverse to the plane of the end frame, a longitudinal frame member extending perpendicularly between said opposing corners, respectively, of said first and second end frames, each of said longitudinal frame members having opposed ends and an internally-threaded bore extending inwardly from each of said ends;

a fastener fastening each of said opposing corners to a respective one of said longitudinal frame members, each said fastener having a head and an externally-threaded shaft, each head having a projecting lip corresponding to and engaging said closed arcuate groove formed in said outer surface of each of said corners, and said externally-threaded shaft extending through the respective corner opening and engaging said internally-threaded bore in said end of said longitudinal frame member extending from said corner, simultaneously locking together the lateral frame members forming the corner and securing the corner to the longitudinal frame member; and a door assembly for insertion into said display frame, said door assembly comprising:

a door; and a door hinge including a pin portion and a barrel portion, said pin portion including a cylindrical pin and a connector of T-shaped cross-section projecting outwardly from said pin and dimensioned to be matingly received in one of said channels, and said barrel portion including at a first end a channel of generally C-shaped cross-section for pivoting engagement with said pin, and at a second end a groove of generally U-shaped cross-section for receiving an edge of said door.

* * * * *